US011444420B2

(12) United States Patent
Lee

(10) Patent No.: US 11,444,420 B2
(45) Date of Patent: Sep. 13, 2022

(54) ELECTRICAL PLUG

(71) Applicant: DONGSAN ELECTRONICS CO., LTD, Gimhae-si (KR)

(72) Inventor: Dae Ho Lee, Gimhae-si (KR)

(73) Assignee: DONGSAN ELECTRONICS CO., LTD, Gimhae-si (KR)

( * ) Notice: Subject to any disclaimer, the term of this patent is extended or adjusted under 35 U.S.C. 154(b) by 0 days.

(21) Appl. No.: 16/942,465

(22) Filed: Jul. 29, 2020

(65) Prior Publication Data

US 2021/0167565 A1 Jun. 3, 2021

Related U.S. Application Data

(63) Continuation of application No. PCT/KR2019/016968, filed on Dec. 4, 2019.

(30) Foreign Application Priority Data

Dec. 2, 2019 (KR) ..... 10-2019-0158638

(51) Int. Cl.

| | |
|---|---|
| ***H01R 25/00*** | (2006.01) |
| ***H01R 31/06*** | (2006.01) |
| ***H01R 27/00*** | (2006.01) |
| *H01R 103/00* | (2006.01) |

(52) U.S. Cl.

CPC ..... *H01R 31/06* (2013.01); *H01R 27/00* (2013.01); *H01R 2103/00* (2013.01)

(58) Field of Classification Search

CPC ..... H01R 29/00; H01R 27/00; H01R 13/03; H01R 24/58; H01R 31/06; H01R 2103/00

USPC ..... 439/638

See application file for complete search history.

(56) References Cited

U.S. PATENT DOCUMENTS

| | | | | |
|---|---|---|---|---|
| 4,579,410 A * | 4/1986 | Soloman | H01R 31/06 | 439/133 |
| 6,416,362 B1 * | 7/2002 | Conrad | H01R 13/6397 | 200/51 R |
| 6,520,787 B1 * | 2/2003 | Lott | H01R 27/00 | 439/166 |
| 6,851,961 B2 * | 2/2005 | Lin | H01R 31/06 | 439/221 |

(Continued)

FOREIGN PATENT DOCUMENTS

KR 10-2002-0044857 A 6/2002

*Primary Examiner* — Thanh Tam T Le

(74) *Attorney, Agent, or Firm* — Studebaker & Brackett PC

(57) ABSTRACT

A plug for combined use and applicable to a variety of electrical outlets having different forms. The plug includes a body plug portion, a connection plug portion attached to or detached from one side of the body plug portion, a push portion fastened to a lateral surface of the body plug portion, a body plug portion body portion, and a body plug portion cover portion which covers the body plug portion body portion. The body plug portion body portion includes a connection plug portion body portion first mounting portion on which the connection plug portion body portion of the connection plug portion is mounted. The connection plug portion body portion first mounting portion includes a first base plate, a first space portion formed above the first base plate, and a fastening hole which is located in an area of the first space portion and passes through the first base plate.

5 Claims, 13 Drawing Sheets

(56) References Cited

U.S. PATENT DOCUMENTS

| | | | | |
|---|---|---|---|---|
| 6,991,482 | B1 * | 1/2006 | Liao | H01R 13/508 439/106 |
| 7,012,403 | B2 * | 3/2006 | Hwang | H02J 7/0044 320/107 |
| 7,306,471 | B2 * | 12/2007 | Shau-din | H01R 24/28 439/104 |
| 7,549,877 | B1 * | 6/2009 | Vista, Jr. | H01R 13/6675 439/172 |
| 8,007,289 | B2 * | 8/2011 | Bandhu | H01R 13/6271 439/79 |
| 8,388,383 | B2 * | 3/2013 | Tsai | H01R 31/06 439/628 |
| 8,558,503 | B2 * | 10/2013 | Jeong | H02J 7/0044 320/107 |
| 8,764,490 | B2 * | 7/2014 | Watanabe | H05K 1/142 439/638 |
| 8,811,051 | B2 * | 8/2014 | Chan | H01R 31/06 363/146 |
| 8,821,193 | B2 * | 9/2014 | Vroom | H01R 27/02 439/638 |
| 8,944,852 | B2 * | 2/2015 | Fukushi | H01R 13/506 439/638 |
| 8,951,075 | B2 * | 2/2015 | Ekchian | H01R 13/4538 439/692 |
| 9,004,951 | B2 * | 4/2015 | Wu | H01R 27/00 439/638 |
| 9,024,581 | B2 * | 5/2015 | McGinley | H02J 7/0042 320/111 |
| 9,235,223 | B2 * | 1/2016 | Carlucci | G05F 1/45 |
| 9,722,373 | B2 * | 8/2017 | Ejiri | H01R 27/00 |
| 9,985,397 | B2 * | 5/2018 | Jiang | H01R 13/6675 |
| 10,910,781 | B2 * | 2/2021 | Iwadare | H01R 31/065 |

* cited by examiner

ELECTRICAL PLUG

CROSS-REFERENCE TO RELATED APPLICATIONS

The present application is a continuation of International Patent Application No. PCT/KR2019/016968, filed Dec. 4, 2019, which is based upon and claims the benefit of priority to Korean Patent Application No. 10-2019-0158638, filed on Dec. 2, 2019. The disclosures of the above-listed applications are hereby incorporated by reference herein in their entirety.

TECHNICAL FIELD

The present invention relates to an electrical plug, and more particularly, to an electrical plug which is applicable to a variety of electrical outlets having different forms.

BACKGROUND ART

In general, a plug, which is connected to an electrical outlet to provide power, is provided at an end of a power supply of an electrical device or electrical product.

A shape of such plugs varies to match power such as 110 V and 220 V used in general homes. Generally, a plug for power of 110 V includes bar-shaped connection members, and a plug for power of 220 V includes cylindrical connection members.

As described above, since power of 110 V or 220 V is supplied to households, in order to use an electrical device or electrical product which is released while being standardized with both voltages, an adapter is mounted on a plug for one type of power to use with another type of power.

An example thereof is shown in FIG. 1.

FIG. 1 is a perspective view illustrating components of a conventional separable plug used for both 110 V and 220 V.

As households in which 220 V is used increase, as shown in the drawing, an existing plug is used for 110 V while an adapter 20 for 110 V is mounted on a plug 10 for 220 V to which an electrical wire is connected. That is, the plug 10 of 220 V which has cylindrical connection members 12 is connected, as it is, to an electrical outlet (not shown) for 220 V, and the adapter 20 for 110 V is mounted on a front part of the plug 10 and bar-shaped connection members 22 are inserted into an electrical outlet for 110 V.

Here, the cylindrical connection members 12 of the plug 10 are electrically connected to the bar-shaped connection members 22 of the adapter 20 by inserting the cylindrical connection members 12 into insertion holes 24 formed in a rear part of the adapter 20.

Universally, connection members for 220 V have a cylindrical shape, and connection members for 110 V are formed as bar-shaped panel members.

On the other hand, there is a product used by mounting an adapter for 220 V on a plug for 110 V to which an electrical wire is connected.

In an existing separable plug as described above, since it is necessary to mount or separate an adapter when 110 V or 220 V is exchanged, it is inconvenient to use the plug. Also, since it is necessary to store the detached and separated adapter, the adapter may be easily lost.

In addition, since an adapter is mounted on a front of a plug, the plug protrudes significantly from a wall structure where an electrical outlet is present such that the plug catches onto people passing therethrough. Accordingly, the plug is frequently detached therefrom and it is difficult to connect the plug to the electrical outlet in a narrow space.

Also, since the plug and the adapter are manufactured as two components, manufacturing costs increase.

DISCLOSURE

Technical Problem

The present invention is directed to providing an electrical plug which is applicable to a variety of electrical outlets having different forms.

Objects of the present invention are not limited to the above-stated objects and other unstated objects of the present invention will be understood by those skilled in the art from the following description.

Technical Solution

One aspect of the present invention provides a connection plug including a connection plug body portion, a first pin portion located on one side of the connection plug body portion, a second pin portion located on the other side of the connection plug body portion, a first slit portion located on a first side surface of the connection plug body portion, and a second slit portion located on a second side surface of the connection plug body portion. Here, the connection plug body portion includes a connection plug first body portion and a connection plug second body portion fastened to the connection plug first body portion. Also, the connection plug body portion includes a first fastening groove located in a certain area of the connection plug first body portion and a second fastening groove located in a certain area of the connection plug second body portion.

The first fastening groove may include a 1-1 fastening groove located adjacent to the first pin portion and a 1-2 fastening groove disposed to be spaced at a certain interval apart from the 1-1 fastening groove and located to be adjacent to the second pin portion, and the second fastening groove may include a 2-1 fastening groove located to be adjacent to the first pin portion and a 2-2 fastening groove disposed to be spaced at a certain interval apart from the 2-1 fastening groove and located to be adjacent to the second pin portion. Also, the first slit portion may include a 1-1 slit located to be adjacent to the first pin portion and a 1-2 slit located to be adjacent to the second pin portion, and the second slit portion may include a 2-1 slit located to be adjacent to the first pin portion and a 2-2 slit located to be adjacent to the second pin portion.

Another aspect of the present invention provides a plug including a body plug portion, a connection plug portion detachably attached to one side of the body plug portion, and a push portion fastened to a lateral surface of the body plug portion. Here, the body plug portion includes a body plug portion body portion and a body plug portion cover portion which covers the body plug portion body portion. The body plug portion body portion includes a connection plug portion body portion first mounting portion on which the connection plug portion body portion of the connection plug portion is mounted, and the connection plug portion body portion first mounting portion includes a first base plate, a first space portion formed above the first base plate, and a fastening hole which is located in an area of the first space portion and passes through the first base plate.

The connection plug may include a connection plug body portion, a first pin portion located on one side of the connection plug body portion, a second pin portion located on the other side of the connection plug body portion, a first slit portion located on a first side surface of the connection plug body portion, and a second slit portion located on a second side surface of the connection plug body portion. Also, the connection plug body portion may include a connection plug first body portion and a connection plug second body portion fastened to the connection plug first body portion and may include a first fastening groove located in a certain area of the connection plug first body portion and a second fastening groove located in a certain area of the connection plug second body portion.

The first fastening groove may include a 1-1 fastening groove located to be adjacent to the first pin portion and a 1-2 fastening groove disposed to be spaced at a certain interval apart from the 1-1 fastening groove and located to be adjacent to the second pin portion, and the second fastening groove may include a 2-1 fastening groove located to be adjacent to the first pin portion and a 2-2 fastening groove disposed to be spaced at a certain interval apart from the 2-1 fastening groove and located to be adjacent to the second pin portion. Also, the first slit portion may include a 1-1 slit located to be adjacent to the first pin portion and a 1-2 slit located to be adjacent to the second pin portion, and the second slit portion may include a 2-1 slit located to be adjacent to the first pin portion and a 2-2 slit located to be adjacent to the second pin portion.

While the connection plug portion is fastened to one side of the body plug portion, the fastening hole and the first fastening groove may be fastened using a fixing device. While the connection plug portion is fastened to the one side of the body plug portion, the fastening hole and the second fastening groove may be fastened using the fixing means.

When the first pin portion is inserted into the body plug portion, the fastening hole and the 1-1 fastening groove may be located in corresponding areas or the fastening hole and the 2-1 fastening groove may be located in corresponding areas. Also, when the second pin portion is inserted into the body plug portion, the fastening hole and the 1-2 fastening groove may be located in corresponding areas or the fastening hole and the 2-2 fastening groove may be located in corresponding areas.

The push portion may include a first push portion fastened to a first side of the body plug portion body portion and a second push portion fastened to a second side of the body plug portion body portion. The connection plug portion body portion first mounting portion may include a first push portion first fastening portion located on a first side of the first base plate and a second push portion first fastening portion located on a second side of the first base plate. The first push portion may include a first push portion body portion, a first push plate located on an outer side surface of the first push portion body portion, a first concave portion located on a rear surface and a front surface of the first push portion body portion, a first holding protruding portion protruding from an inner side surface of the first push portion body portion, an elastic body first support portion protruding from a bottom surface of the first push portion body portion, and a first elastic body inserted into the elastic body first support portion. The second push portion may include a second push portion body portion, a second push plate located on an outer side surface of the second push portion body portion, a second concave portion located on a rear surface and a front surface of the second push portion body portion, a second holding protruding portion protruding from an inner side surface of the second push portion body portion, an elastic body second support portion protruding from a bottom surface of the second push portion body portion, and a second elastic body inserted into the elastic body second support portion. Also, the first concave portion may include a 1-1 concave portion located on the rear surface of the first push portion body portion and a 1-2 concave portion located on the front surface of the first push portion body portion, and the second concave portion may include a 2-1 concave portion located on the rear surface of the second push portion body portion and a 2-2 concave portion located on the front surface of the second push portion body portion.

When the first pin portion is inserted into the body plug portion, the first holding protruding portion may be inserted into the 1-1 slit and the second holding protruding portion may be inserted into the 2-1 slit or the first holding protruding portion may be inserted into the 2-1 slit and the second holding protruding portion may be inserted into the 1-1 slit. Also, when the second pin portion is inserted into the body plug portion, the first holding protruding portion may be inserted into the 1-2 slit and the second holding protruding portion may be inserted into the 2-2 slit or the first holding protruding portion may be inserted into the 2-2 slit and the second holding protruding portion may be inserted into the 1-2 slit.

The body plug portion body portion may include a connection plug portion pin portion first connection portion located continuously with the connection plug portion body portion first mounting portion. The connection plug portion pin portion first connection portion may include a pin portion connection terminal. The pin portion connection terminal may include a pin portion first connection terminal and a pin portion second connection terminal disposed to be spaced at a certain interval apart from the pin portion first connection terminal. The pin portion first connection terminal may include a first base terminal, a first fastening terminal extending from a side surface of one side of the first base terminal in a longitudinal direction, a first pin portion first insertion portion located in a 1-1 area above the first base terminal, and a second pin portion first insertion portion located in a 1-2 area above the first base terminal to be adjacent to the first pin portion first insertion portion. The first pin portion first insertion portion may include a 1-1 plate extending from a side surface of the other side of the first base terminal in the longitudinal direction and located in a state of being bent from the first base terminal at a certain angle, and the second pin portion first insertion portion may include a 1-2 plate extending from a side surface of one side of the first base terminal in a width direction and located in a state of being bent from the first base terminal at a certain angle and a 1-3 plate which is disposed to face the 1-2 plate, extends from a side surface of the other side of the first base terminal in the width direction, and is located in a state of being bent from the first base terminal at a certain angle. The first pin portion first insertion portion may include a first pin portion first insertion space located between the 1-2 plate, a side surface of the 1-3 plate, and a plate surface of the 1-1 plate, and the second pin portion first insertion portion may include a second pin portion first insertion space located between a plate surface of the 1-2 plate and a plate surface of the 1-3 plate. The pin portion second connection terminal may include a second base terminal, a second fastening terminal extending from a side surface of one side of the second base terminal in a longitudinal direction, a first pin portion second insertion portion located in a 2-1 area above the second base terminal, and a second pin portion second insertion portion located in a 2-2 area above the second base terminal to be adjacent to the first pin portion second insertion portion. The first pin portion second insertion portion may include a 2-1 plate extending from a side surface of the other side of the second base terminal in the longitudinal direction and located in a state of being bent from the second base terminal at a certain angle, and the second pin portion second insertion portion may include a 2-2 plate extending from a side surface of one side of the second base terminal in a width direction and located in a state of being bent from the second base terminal at a certain angle and a 2-3 plate which is disposed to face the 2-2 plate, extends from a side surface of the other side of the second base terminal in the width direction, and is located in a state of being bent from the second base terminal at a certain angle. Also, the first pin portion second insertion portion may include a first pin portion second insertion space located between the 2-2 plate, a side surface of the 2-3 plate, and a plate surface of the 2-1 plate, and the second pin portion second insertion portion may include a second pin portion second insertion space located between a plate surface of the 2-2 plate and a plate surface of the 2-3 plate.

Advantageous Effects

According to the present invention, since whether a second pin portion of a connection plug is inserted into an electrical outlet or a first pin portion of the connection plug is inserted into the electrical outlet varies depending on whether the first pin portion is inserted into a body plug portion or the second pin portion is inserted into the body plug portion, a plug for combined use which is applicable to a variety of electrical outlets having different forms may be provided.

DETAILED DESCRIPTION

Figure 1:
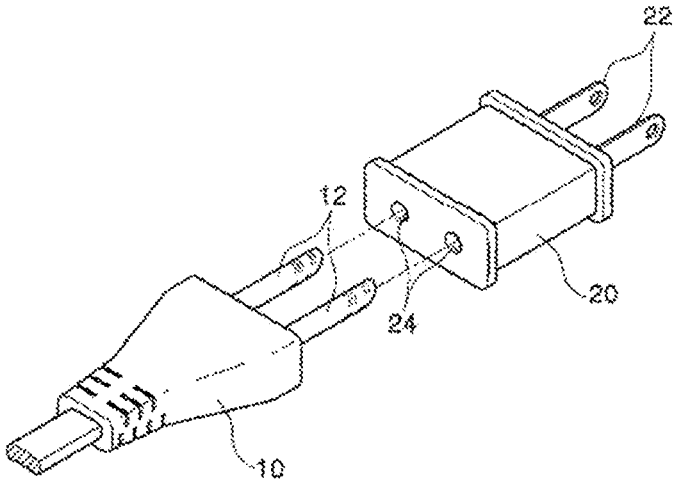
FIG. 1 is a perspective view illustrating components of a conventional separable plug used for both 110 V and 220 V.

The advantages and features of the present invention and a method of achieving the same will become apparent with reference to the attached drawings and following embodiments which will be described below in detail. However, the present invention is not limited to the embodiments which will be described below and may be implemented as a variety of different shapes. It should be noted that the embodiments are provided merely for completing the disclosure of the present invention and allowing one of ordinary skill in the art to understand the complete scope of the present invention and the present invention will be defined by the claims.

Detailed content for implementing the present invention will be described in detail with reference to the attached drawings. Regardless of the drawings, like reference numerals refer to like elements, and the terms "and/or" include any and all combinations of one or a plurality of stated items.

Although the terms such as first, second, and the like are used for describing a variety of elements, the elements are not limited to the terms. These terms are merely used for distinguishing one element from another element. Accordingly, a first element stated hereafter may be a second element within the technical concept of the present invention.

The terms used herein are intended to describe the embodiments but not intended to restrict the present invention. In the specification, unless stated otherwise particularly, singular forms include plural forms. The terms such as "comprises" and/or "comprising" used herein do not exclude the presence or addition of one or more elements in addition to stated elements.

Unless defined otherwise, the terms (including technical and scientific terms) used herein may be used as meanings capable of being commonly understood by one of ordinary skill in the art. Also, terms defined in generally used dictionaries, unless particularly defined, are not to be ideally or excessively construed.

The terms "below," "beneath," "lower," "above," "upper," and the like which are spatially relative terms may be used to easily describe a relationship between one element and other elements as shown in the drawings. The spatially relative terms should be understood as terms including mutually different directions of elements when the elements are used or operate in addition to directions shown in the drawings. For example, when elements shown in the drawings are turned upside down, one element described as being "below" or "beneath" another element may be placed "above" the other element. Accordingly, "below" which is an exemplary term may include both downward and upward directions. An element may be oriented in a different direction such that the spatially relative terms may be construed according to orientation.

Hereinafter, exemplary embodiments of the present invention will be described in detail with reference to the attached drawings.

Figure 2:
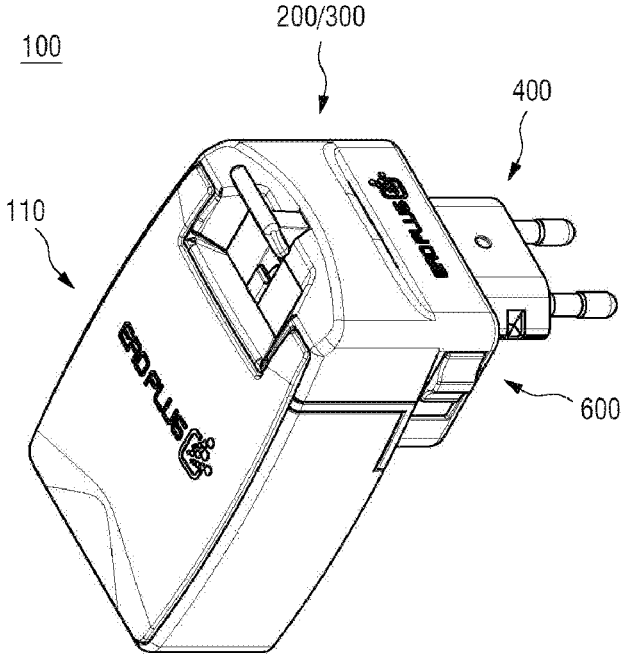
FIG. 2 is a perspective view illustrating an electrical plug according to the present invention.
Figure 3:
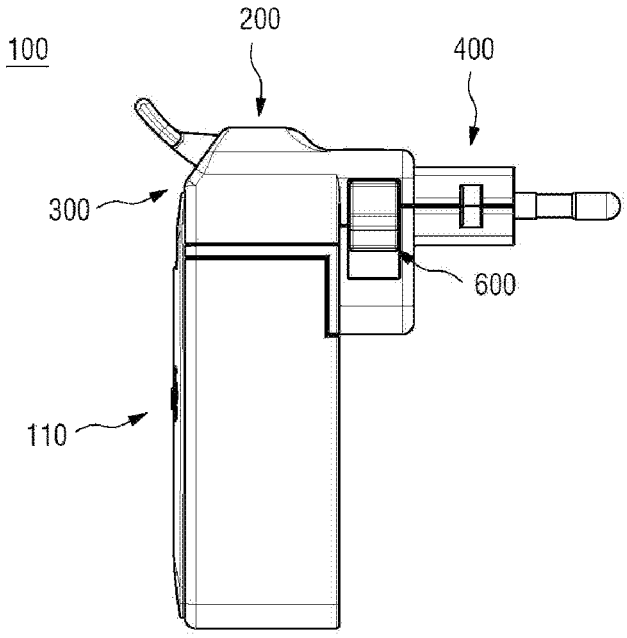
FIG. 3 is a side view illustrating the electrical plug according to the present invention.
Figure 4:
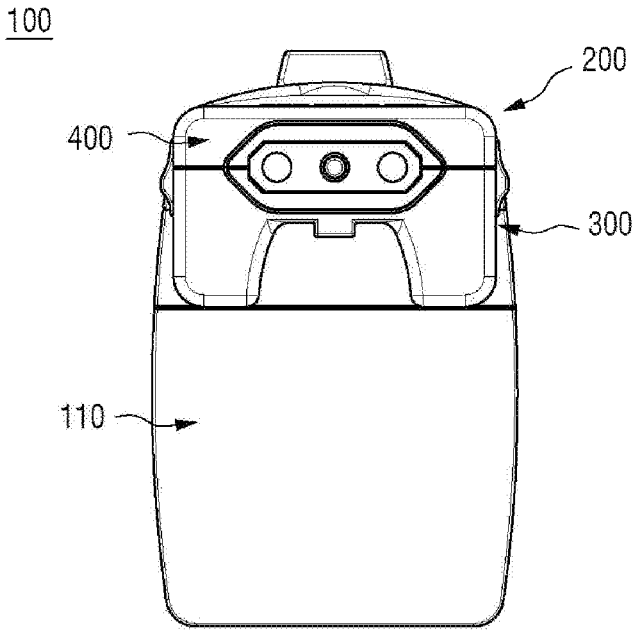
FIG. 4 is a front view illustrating the electrical plug according to the present invention.

FIG. 2 is a perspective view illustrating an electrical plug according to the present invention, FIG. 3 is a side view illustrating the electrical plug according to the present invention, and FIG. 4 is a front view illustrating the electrical plug according to the present invention.

Referring to FIGS. 2 to 4, an electrical plug 100 (hereinafter, referred to as "plug") according to the present invention includes a body plug portion 200 and 300 and a connection plug portion 400 attached to or detached from one side of the body plug portion 200 and 300.

Also, the plug 100 according to the present invention may include an auxiliary plug portion 110 located on the other side of the body plug portion 200 and 300.

In the auxiliary plug portion 110, components such as a variety of wires or a circuit board may be inserted. For example, a wire or a circuit board which is connected to a pin of the connection plug portion which will be described below may be located in the auxiliary plug portion 110. However, the present invention is not intended to restrict whether the auxiliary plug portion 110 is present or not.

Subsequently, referring to FIGS. 2 to 4, the body plug portion 200 and 300 of the plug 100 according to the present invention includes a body plug portion body portion 300 and a body plug portion cover portion 200 which covers the body plug portion body portion 300.

Also, the plug 100 according to the present invention includes a push portion 600 fastened to a side of the body plug portion body portion 300.

That is, the body plug portion cover portion 200 may be fastened to or separated from the body plug portion body portion 300. As described below, while the push portion 600 is fastened to the side of the body plug portion body portion 300, the body plug portion cover portion 200 may be fastened to the body plug portion body portion 300 so as to prevent the push portion 600 from being separated from the body plug portion body portion 300.

Accordingly, it may be defined that the push portion 600 is fastened to the side of the body plug portion body portion 300 and a side of the body plug portion cover portion 200.

Meanwhile, the body plug portion cover portion 200 may be fastened to the body plug portion body portion 300 using a well-known fastening means, for example, screw coupling, bolt-and-nut coupling, and the like. The present invention is not intended to restrict the fastening means for the body plug portion cover portion 200 and the body plug portion body portion 300.

Hereinafter, the plug according to the present invention will be described in detail.

Figure 5:
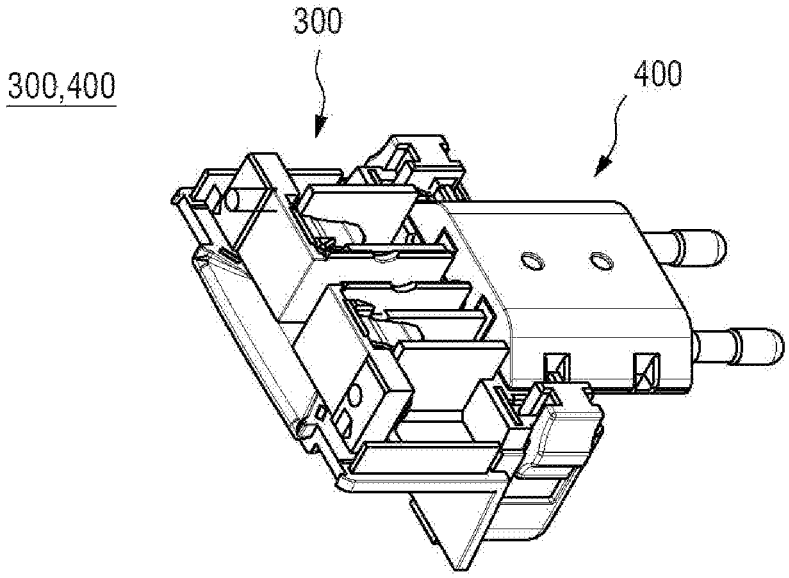
FIG. 5 is a perspective view illustrating a fastening state of a body plug portion body portion and a connection plug portion according to the present invention.
Figure 6:
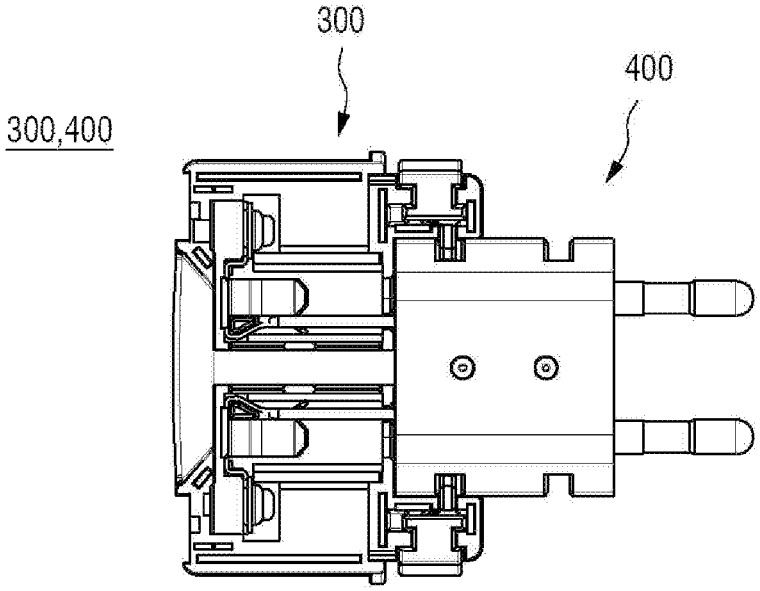
FIG. 6 is a plane view illustrating the fastening state of the body plug portion body portion and the connection plug portion.
Figure 7:
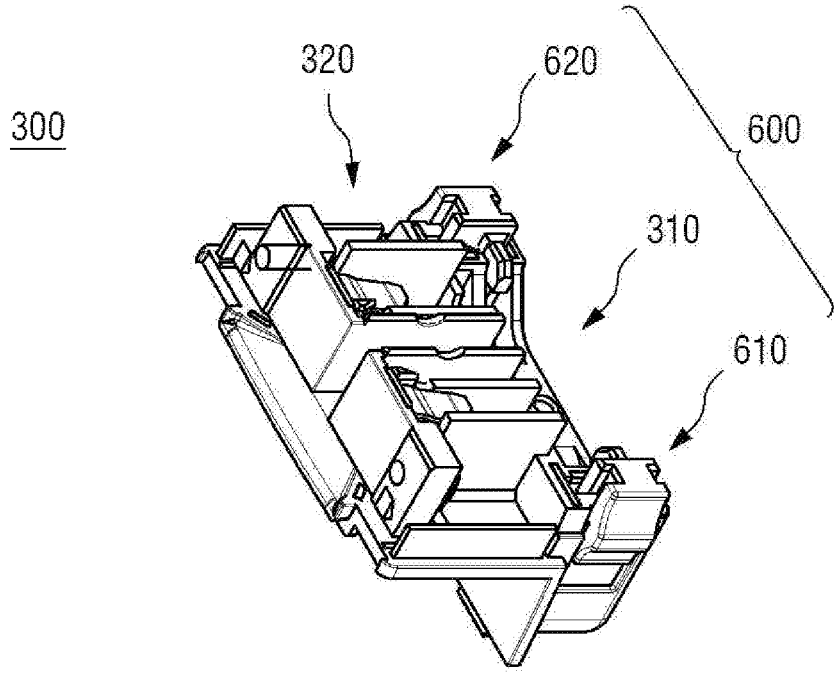
FIG. 7 is a perspective view illustrating the body plug portion body portion according to the present invention.
Figure 8:
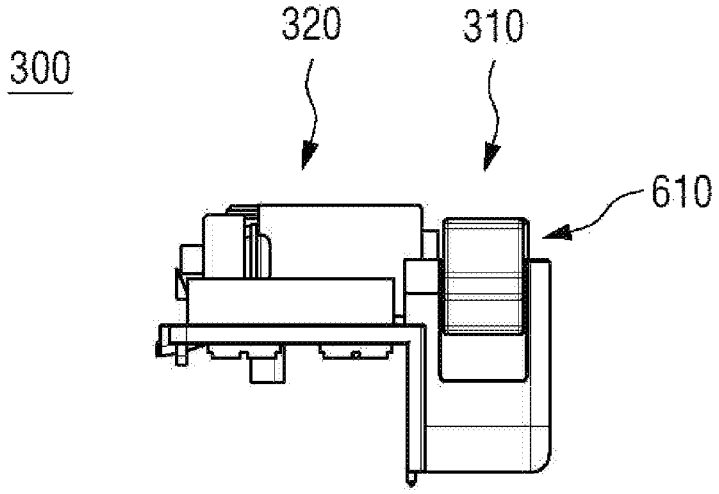
FIG. 8 is a side view illustrating body plug portion body portion according to the present invention.
Figure 9:
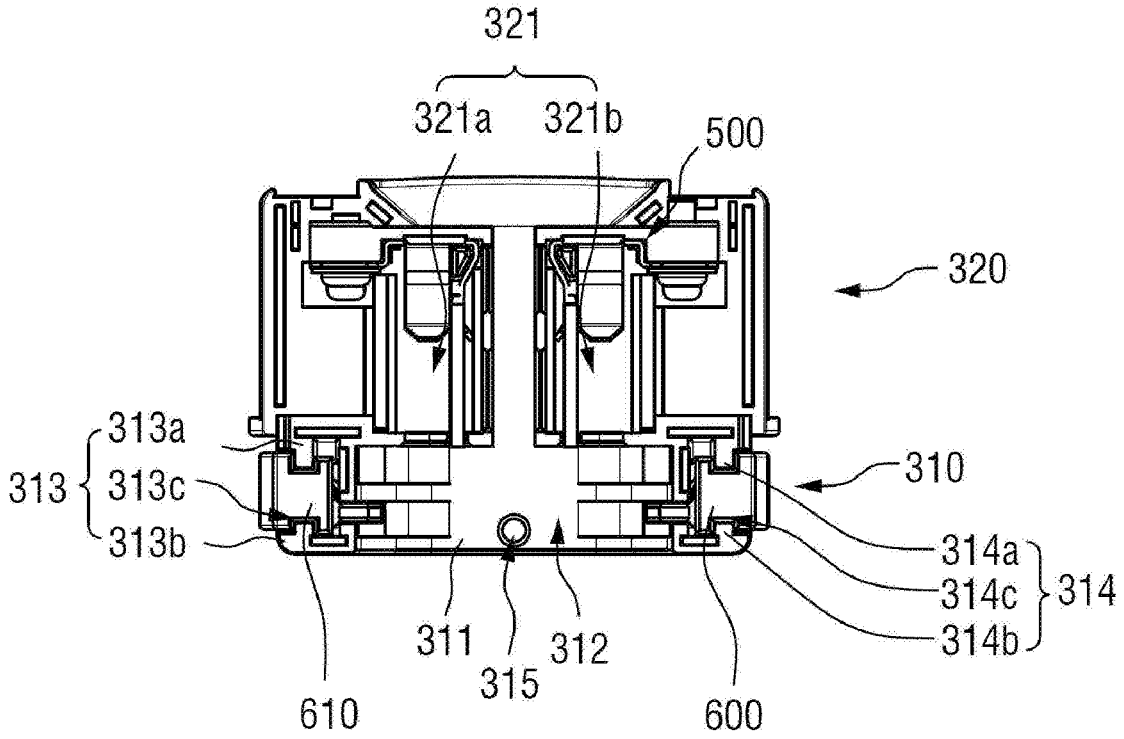
FIG. 9 is a plane view illustrating the body plug portion body portion according to the present invention.
Figure 10:
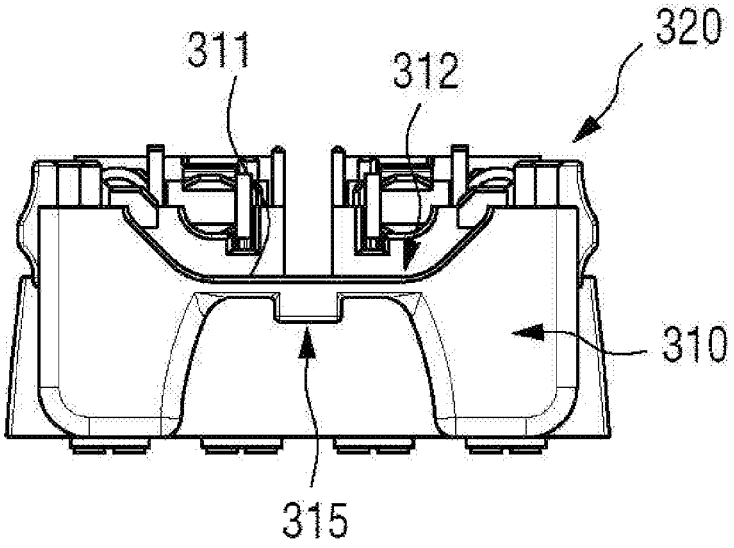
FIG. 10 is a front view illustrating the body plug portion body portion according to the present invention.

FIG. 5 is a perspective view illustrating a fastening state of the body plug portion body portion and the connection plug portion according to the present invention, FIG. 6 is a plane view illustrating the fastening state of the body plug portion body portion and the connection plug portion, FIG. 7 is a perspective view illustrating the body plug portion body portion according to the present invention, FIG. 8 is a side view illustrating the body plug portion body portion according to the present invention, FIG. 9 is a plane view illustrating the body plug portion body portion according to the present invention, and FIG. 10 is a front view illustrating the body plug portion body portion according to the present invention.

That is, in FIGS. 5 and 6, for convenience of description, the plug according to the present invention, excluding the body plug portion cover portion and the auxiliary plug portion, is shown. In FIGS. 7 to 10, the plug according to the present invention, excluding the body plug portion cover portion, the auxiliary plug portion, and the connection plug, is shown.

Referring to FIGS. 5 to 10, the body plug portion body portion 300 includes a connection plug portion body portion first mounting portion 310, on which the connection plug portion body portion of the connection plug portion 400 is mounted, and a connection plug portion pin portion first connection portion 320 located consecutively with the connection plug portion body portion first mounting portion 310.

That is, as described below, the connection plug portion 400 according to the present invention includes a connection plug portion body portion 410 and 420 (refer to FIG. 14) and includes a first pin portion 450 (refer to FIG. 14) located on one side of the connection plug portion body portion 410 and 420 and a second pin portion 460 (refer to FIG. 14) located on the other side of the connection plug portion body portion 410 and 420. The connection plug portion body portion 410 and 420 is located on the connection plug portion body portion first mounting portion 310, and the first pin portion 450 or the second pin portion 460 may be connected to the connection plug portion pin portion first connection portion 320 to be electrically connected.

Subsequently, referring to FIGS. 5 to 10, the connection plug portion body portion first mounting portion 310 includes a first base plate 311 and a first space portion 312 formed above the first base plate 311.

Here, the connection plug portion body portion 410 and 420 of the connection plug portion 400 may be mounted on the first space portion 312.

Meanwhile, as described above, the plug 100 according to the present invention includes the push portion 600 fastened to the side of the body plug portion body portion 300, and the push portion 600 includes a first push portion 610 fastened to a first side of the body plug portion body portion 300 and a second push portion 620 fastened to a second side of the body plug portion body portion 300.

Here, the connection plug portion body portion first mounting portion 310 includes a first push portion first fastening portion 313 located on a first side of the first base plate 311 and a second push portion first fastening portion 314 located on a second side of the first base plate 311. That is, the first push portion 610 is fastened to the first push portion first fastening portion 313, and the second push portion 620 is fastened to the second push portion first fastening portion 314.

In more detail, the first push portion first fastening portion 313 includes a 1-1 protruding portion 313*a*, a 1-2 protruding portion 313*b* disposed to be spaced at a certain interval apart from the 1-1 protruding portion 313*a*, and a 1-1 gap 313*c* according to the interval between the 1-1 protruding portion 313*a* and the 1-2 protruding portion 313*b*. The second push portion first fastening portion 314 includes a 2-1 protruding portion 314*a*, a 2-2 protruding portion 314*b* disposed to be spaced at a certain interval from the 2-1 protruding portion

314*a*, and a 2-1 gap 314*c* according to the interval between the 2-1 protruding portion 314*a* and the 2-2 protruding portion 314*b*.

Fastening between the first push portion and the second push portion through the first push portion first fastening portion 313 and the second push portion first fastening portion 314 will be described below.

Also, the connection plug portion body portion first mounting portion 310 includes a fastening hole 315 which is located in an area of the first space portion 312 of the first base plate 311 and passes through the first base plate 311.

The fastening hole 315 is for fixing the connection plug portion 400, which will be described below.

Subsequently, referring to FIGS. 5 to 10, the connection plug portion pin portion first connection portion 320 includes a pin portion connection terminal 500 and a pin portion connection terminal first disposition portion 321.

Here, as described below, the pin portion connection terminal 500 includes a pin portion first connection terminal 510 (refer to FIG. 24) and a pin portion second connection terminal 520 (refer to FIG. 24) disposed to be spaced at a certain interval apart from the pin portion first connection terminal 510. The pin portion connection terminal first disposition portion 321 may include a pin portion first connection terminal first disposition portion 321*a* on which the pin portion first connection terminal 510 is disposed and a pin portion second connection terminal first disposition portion 321*b* on which the pin portion second connection terminal 520 (refer to FIG. 23) is disposed.

As described below, the first pin portion 450 or the second pin portion 460 may be fastened and electrically connected to the pin portion connection terminal 500.

Figure 11:
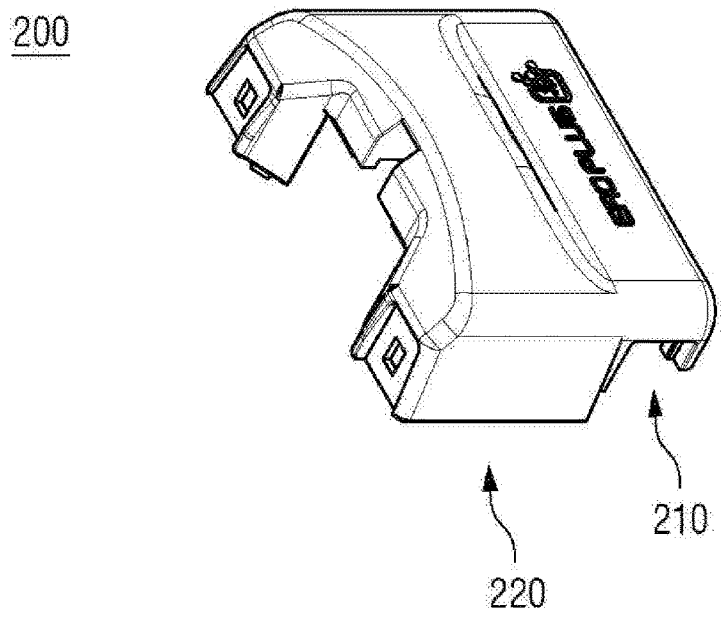
FIG. 11 is a perspective view illustrating a body plug portion cover portion according to the present invention.
Figure 12:
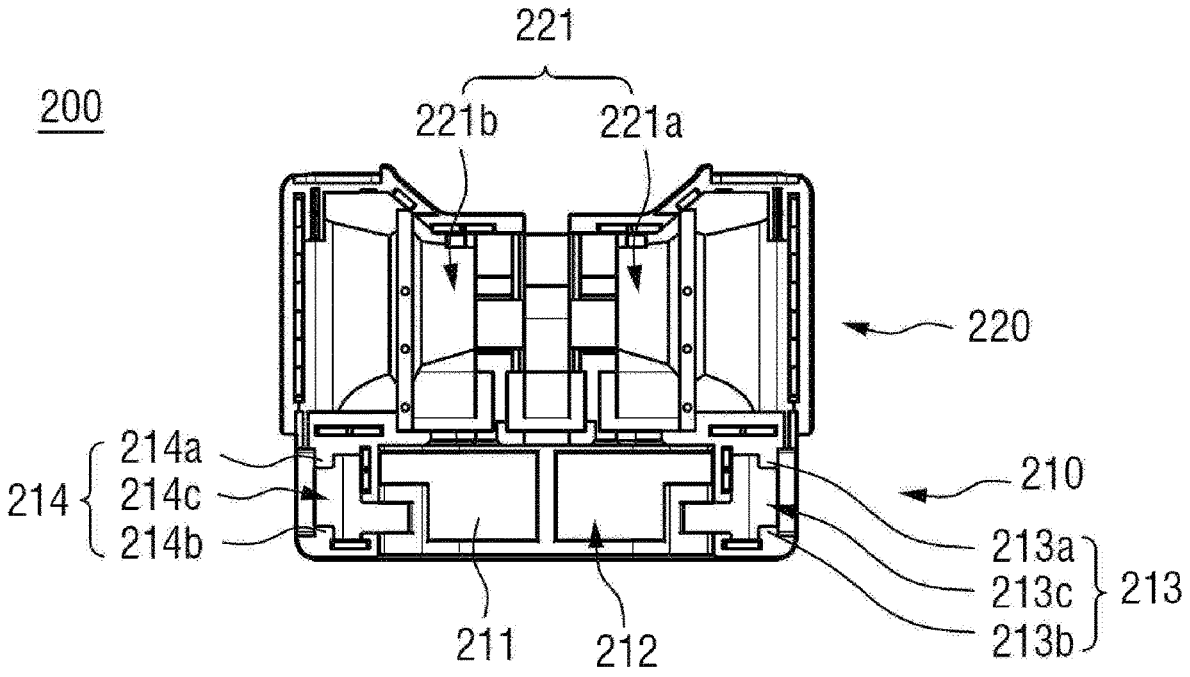
FIG. 12 is a plane view illustrating the body plug portion cover portion according to the present invention.
Figure 13:
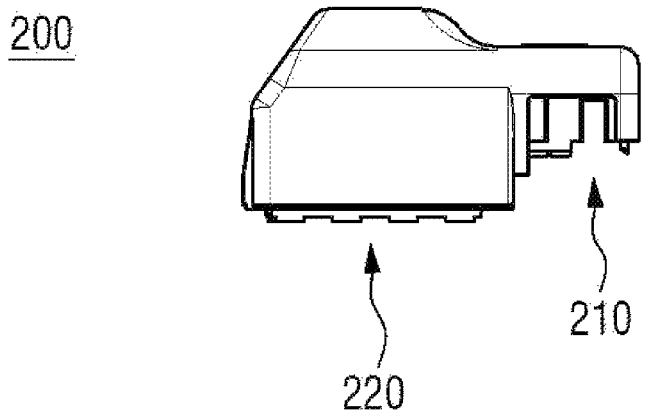
FIG. 13 is a side view illustrating the body plug portion cover portion according to the present invention.

FIG. 11 is a perspective view illustrating the body plug portion cover portion according to the present invention, FIG. 12 is a plane view illustrating the body plug portion cover portion according to the present invention, and FIG. 13 is a side view illustrating the body plug portion cover portion according to the present invention.

As described above, the body plug portion 200 and 300 of the plug 100 according to the present invention includes the body plug portion body portion 300, the body plug portion cover portion 200 which covers the body plug portion body portion 300, and the push portion 600 fastened to the side of the body plug portion body portion 300.

Here, the body plug portion cover portion 200 may be fastened to or separated from the body plug portion body portion 300. While the push portion 600 is fastened to the side of the body plug portion body portion 300, the body plug portion cover portion 200 may be fastened to the body plug portion body portion 300 so as to prevent the push portion 600 from being separated from the body plug portion body portion 300.

In more detail, referring to FIGS. 11 to 13, the body plug portion cover portion 200 includes a connection plug portion body portion second mounting portion 210, on which the connection plug portion body portion of the connection plug portion 400 is mounted, and a connection plug portion pin portion second connection portion 220 located consecutively with the connection plug portion body portion second mounting portion 210.

Here, the connection plug portion body portion second mounting portion 210 of the body plug portion cover portion 200 is located in an area corresponding to the connection plug portion body portion first mounting portion 310 of the body plug portion body portion 300. Also, the connection plug portion pin portion second connection portion 220 of the body plug portion cover portion 200 is located at a position in an area corresponding to the connection plug portion pin portion first connection portion 320 of the body plug portion body portion 300.

Accordingly, the connection plug portion body portion 410 and 420 is located in an area of the connection plug portion body portion mounting portion 210 and 310. Also, the first pin portion 450 or the second pin portion 460 is located in an area of the connection plug portion pin portion connection portion 220 and 320.

Subsequently, referring to FIGS. 11 to 13, the connection plug portion body portion second mounting portion 210 includes a second base plate 211 and a second space portion 212 formed above the second base plate 211.

Here, the connection plug portion body portion 410 and 420 of the connection plug portion 400 may be mounted on the second space portion 212.

Meanwhile, as described above, the plug 100 according to the present invention includes the push portion 600 fastened to the side of the body plug portion body portion 300, and the push portion 600 includes the first push portion 610 fastened to the first side of the body plug portion body portion 300 and the second push portion 620 fastened to the second side of the body plug portion body portion 300.

Here, the connection plug portion body portion second mounting portion 210 includes a first push portion second fastening portion 213 located on a first side of the second base plate 211 and a second push portion second fastening portion 214 located on a second side of the second base plate 211. That is, the first push portion 610 is fastened to the first push portion second fastening portion 213, and the second push portion 620 is fastened to the second push portion second fastening portion 214.

In more detail, the first push portion second fastening portion 213 includes a 1-3 protruding portion 213*a*, a 1-4 protruding portion 213*b* disposed to be spaced at a certain interval apart from the 1-3 protruding portion 213*a*, and a 1-2 gap 213*c* according to the interval between the 1-3 protruding portion 213*a* and the 1-4 protruding portion 213*b*. The second push portion second fastening portion 214 includes a 2-3 protruding portion 214*a*, a 2-4 protruding portion 214*b* disposed to be spaced at a certain interval from the 2-3 protruding portion 214*a*, and a 2-2 gap 214*c* according to the interval between the 2-3 protruding portion 214*a* and the 2-4 protruding portion 214*b*.

That is, the first push portion 610 is fastened to the first push portion first fastening portion 313 and the first push portion second fastening portion 213, and the second push portion 620 is fastened to the second push portion first fastening portion 314 and the second push portion second fastening portion 214.

Subsequently, referring to FIGS. 11 to 13, the connection plug portion pin portion second connection portion 220 includes a pin portion connection terminal second disposition portion 221. The pin portion connection terminal second disposition portion 221 may include a pin portion first connection terminal second disposition 221*a* on which the pin portion first connection terminal 510 is disposed and a pin portion second connection terminal second disposition portion 221*b* on which the pin portion second connection terminal 520 is disposed.

Here, the pin portion first connection terminal first disposition portion 321*a* and the pin portion first connection terminal second disposition portion 221*a* may be located in corresponding areas. The pin portion second connection terminal first disposition portion 321*b* and the pin portion second connection terminal second disposition portion 221*b* may be located in corresponding areas. The pin portion first connection terminal may be disposed in an area of the pin portion first connection terminal disposition portions 321*a* and 221*a*, and the pin portion second connection terminal may be disposed in an area of the pin portion second connection terminal disposition portions 321*b* and 221*b*.

Figure 14:
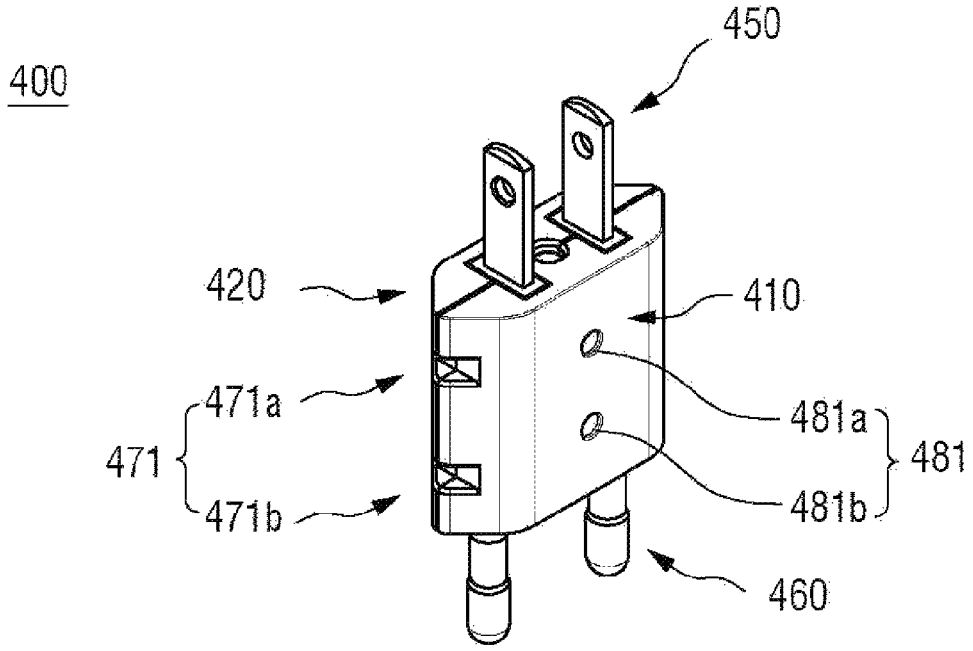
FIG. 14 is a perspective view illustrating a connection plug according to the present invention.
Figure 15:
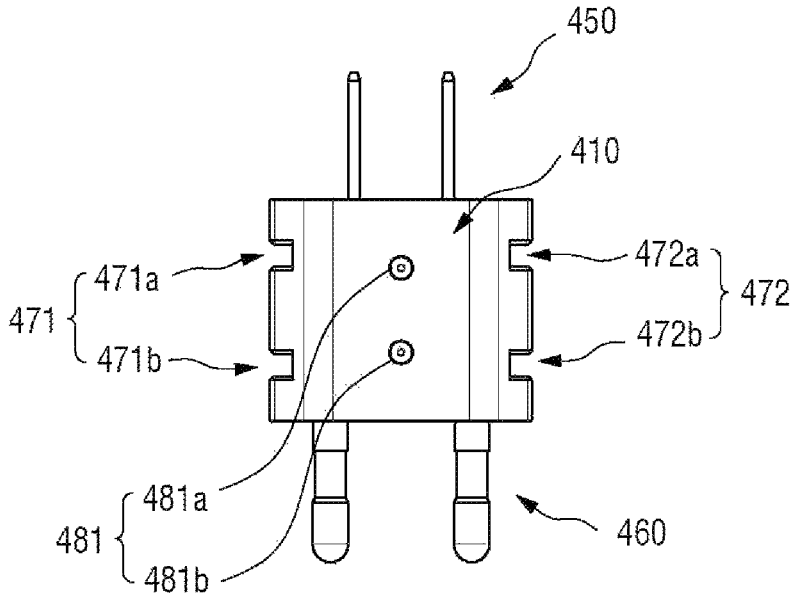
FIG. 15 is a front view illustrating the connection plug according to the present invention.
Figure 16:
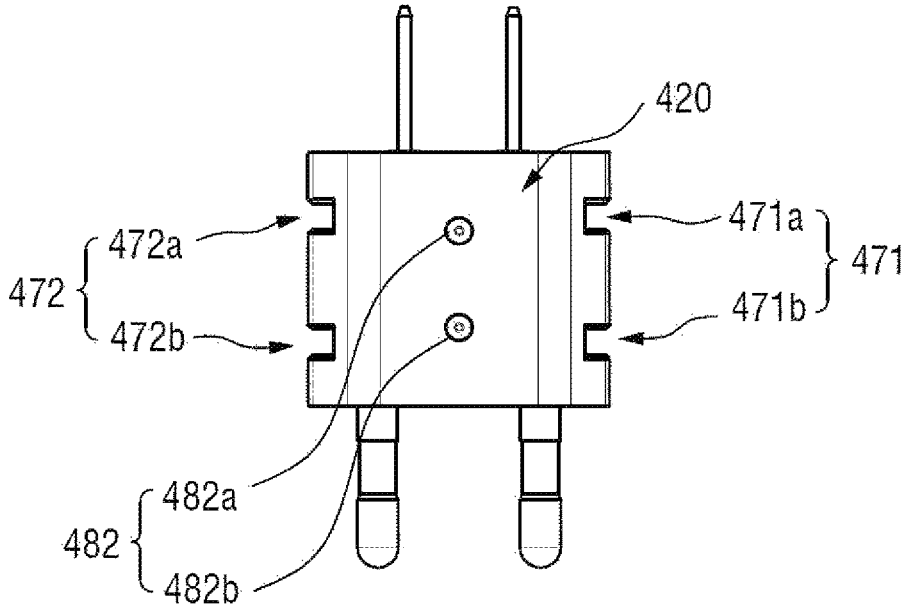
FIG. 16 is a rear view illustrating the connection plug according to the present invention.
Figure 17:
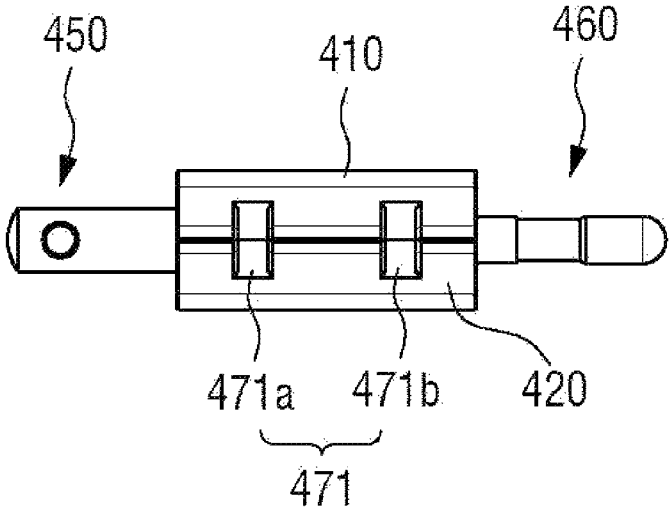
FIG. 17 is a side view illustrating the connection plug according to the present invention.

FIG. 14 is a perspective view illustrating the connection plug according to the present invention, FIG. 15 is a front view illustrating the connection plug according to the present invention, FIG. 16 is a rear view illustrating the connection plug according to the present invention, and FIG. 17 is a side view illustrating the connection plug according to the present invention.

Figure 18:
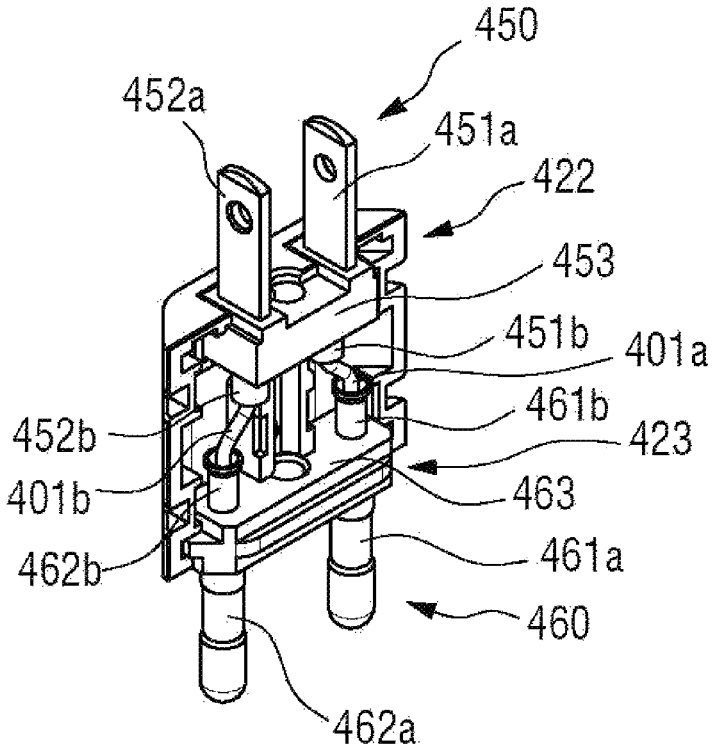
FIG. 18 is a perspective view illustrating the connection plug according to the present invention excluding a first body portion.
Figure 19:
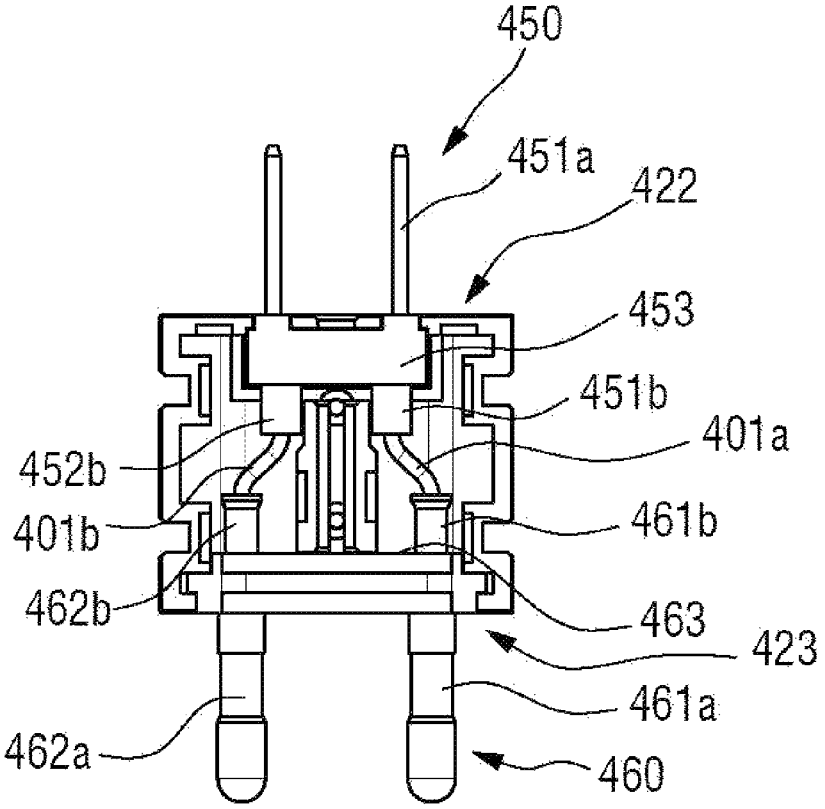
FIG. 19 is a front view illustrating the connection plug according to the present invention excluding the first body portion.

Also, FIG. 18 is a perspective view illustrating the connection plug according to the present invention excluding a first body portion, and FIG. 19 is a front view illustrating the connection plug according to the present invention excluding the first body portion.

That is, in FIGS. 18 and 19, for convenience of description, the connection plug portion is shown excluding the first body portion.

Referring to FIGS. 14 to 19, the connection plug 400 according to the present invention includes the connection plug body portion 410 and 420, the first pin portion 450 located on one side of the connection plug body portion 410 and 420, and the second pin portion 460 located on the other side of the connection plug body portion 410 and 420.

Here, the first pin portion 450 may be a pin portion for 110 V and the second pin portion 460 may be a pin portion for 220 V. However, the present invention does not restrict voltage ranges of the first pin portion 450 and the second pin portion 460.

Also, the connection plug body portion 410 and 420 includes a connection plug first body portion 410 and a connection plug second body portion 420 fastened to the connection plug first body portion 410.

That is, the connection plug first body portion 410 and the connection plug second body portion 420 are fastened to form the connection plug body portion 410 and 420.

Here, the connection plug body portion 410 and 420 includes a first pin portion fastening portion 422 located on one side and a second pin portion fastening portion 423 located on the other side. That is, the first pin portion 450 may be fastened to the first pin portion fastening portion 422 and the second pin portion 460 may be fastened to the second pin portion fastening portion 423.

Subsequently, referring to FIGS. 14 to 19, the first pin portion 450 includes a first pin portion fixing portion 453, 1-1 pins 451*a* and 451*b* fixed to one side of the first pin portion fixing portion 453, and 1-2 pins 452*a* and 452*b* fixed to the other side of the first pin portion fixing portion 453.

Here, the 1-1 pins 451*a* and 451*b* include one side 1-1 pin 451*a* located on one side of the first pin portion fixing portion 453 and the other side 1-1 pin 451*b* located on the other side of the first pin portion fixing portion 453. Also, the 1-2 pins 452*a* and 452*b* include one side 1-2 pin 452*a* located on one side of the first pin portion fixing portion 453 and the other side 1-2 pin 452*b* located on the other side of the first pin portion fixing portion 453.

Also, the second pin portion 460 includes a second pin portion fixing portion 463, 2-1 pins 461*a* and 461*b* fixed to one side of the second pin portion fixing portion 463, and 2-2 pins 462*a* and 462*b* fixed to the other side of the second pin portion fixing portion 463.

Here, the 2-1 pins 461*a* and 461*b* include one side 2-1 pin 461*a* located on one side of the second pin portion fixing portion 461 and the other side 2-1 pin 461*b* located on the other side of the second pin portion fixing portion 463. Also, the 2-2 pins 462*a* and 462*b* include one side 2-2 pin 462*a* located on one side of the second pin portion fixing portion 463 and the other side 2-2 pin 462*b* located on the other side of the second pin portion fixing portion 463.

Meanwhile, as shown in the drawings, the one side 1-1 pin 451*a* and the one side 1-2 pin 452*a* may protrude outward from the connection plug body portion 410 and 420 and be inserted into an electrical outlet, and the other side 1-1 pin 451*b* and the other side 1-2 pin 452*b* may be located inside the connection plug body portion 410 and 420.

Also, the one side 2-1 pin 461*a* and the one side 2-2 pin 462*a* may protrude outward from the connection plug body portion 410 and 420 and be inserted into an electrical outlet, and the other side 2-1 pin 461*b* and the other side 2-2 pin 462*b* may be located inside the connection plug body portion 410 and 420.

Also, the connection plug body portion 410 and 420 includes a first connection wire 401*a*, which connects the other side 1-1 pin 451*b* to the other side 2-1 pin 461*b*, and a second connection wire 401*b* which connects the other side 1-2 pin 452*b* to the other side 2-2 pin 462*b*. The other side 1-1 pin 451*b* and the other side 2-1 pin 461*b* may be electrically connected by the first connection wire 401*a*, and the other side 1-2 pin 452*b* and the other side 2-2 pin 462*b* may be electrically connected by the second connection wire 401*b*.

Subsequently, referring to FIGS. 14 to 19, the connection plug 400 according to the present invention includes a first slit portion 471 located on a first side surface of the connection plug body portion 410 and 420 and a second slit portion 472 located on a second side surface of the connection plug body portion 410 and 420.

In more detail, the first slit portion 471 includes a 1-1 slit 471*a* located on the first side surface of the connection plug body portion 410 and 420 to be adjacent to the first pin portion 450 and a 1-2 slit 471*b* located on the first side surface of the connection plug body portion 410 and 420 to be adjacent to the second pin portion 460. Also, the second slit portion 472 includes a 2-1 slit 472*a* located on the second side surface of the connection plug body portion 410 and 420 to be adjacent to the first pin portion 450 and a 2-2 slit 472*b* located on the second side surface of the connection plug body portion 410 and 420 to be adjacent to the second pin portion 460.

Here, although the number of slits of each of the first slit portion and the second slit portion is two in the drawings, in the present invention, one or more slits may be included and the number of the slits is not limited.

However, in the present invention, when the connection plug is coupled to the one side of the body plug portion 200 and 300, some components of the push portion have to be insertable into slits of the slit portion as described above. This will be described below.

Meanwhile, the slits according to the present invention are located on the first side surface of the connection plug body portion 410 and 420 or the second side surface of the connection plug body portion 410 and 420 while being continuously located from the connection plug first body portion 410 to the connection plug second body portion 420.

A configuration of the slit of the slit portion will be described below.

Subsequently, referring to FIGS. 14 to 19, the connection plug first body portion 410 according to the present invention includes a first fastening groove 481 located in a certain area of the connection plug first body portion 410, and the connection plug second body portion 420 according to the present invention includes a second fastening groove 482 located in a certain area of the connection plug second body portion 420.

As described above with reference to FIGS. 9 and 10, the connection plug portion body portion first mounting portion 310 includes the fastening hole 315 which is located in an area of the first space portion 312 of the first base plate 311 and passes through the first base plate 311.

Also, as described above, the electrical plug 100 according to the present invention includes the body plug portion 200 and 300 and the connection plug portion 400 attached to or detached from the one side of the body plug portion 200 and 300.

That is, the connection plug portion 400 according to the present invention is attached to or detached from the one side of the body plug portion 200 and 300. Accordingly, the connection plug portion 400 may be fastened to the body plug portion 200 and 300 or the connection plug portion 400 may be separated from the body plug portion 200 and 300.

Here, while the connection plug portion 400 is fastened to the one side of the body plug portion 200 and 300, the fastening hole 315 and the first fastening groove 481 may be fastened by fixing means so as to prevent the connection plug portion 400 from being arbitrarily separated from the one side of the body plug portion 200 and 300.

Also, on the other hand, while the connection plug portion 400 is fastened to the one side of the body plug portion 200 and 300, the fastening hole 315 and the second fastening groove 482 may be fastened by the fixing means so as to prevent the connection plug portion 400 from being arbitrarily separated from the one side of the body plug portion 200 and 300.

Here, the fixing means may be a well-known screw. That is, the fastening hole 315 and the first fastening groove 481 may be fixed or the fastening hole 315 and the second fastening groove 482 may be fixed by the screw so as to prevent the connection plug portion 400 from being arbitrarily separated from the one side of the body plug portion 200 and 300.

Meanwhile, when the screw passes through the connection plug first body portion 410, since the screw comes into contact with internal components of the connection plug portion 400 such that an electric shock accident occurs due to the screw, the screw should not pass through the connection plug first body portion 410, and thus, the first fastening groove 481 should be configured as a groove not a hole.

Due to the same reason, when the screw passes through the connection plug second body portion 420, since the screw comes into contact with internal components of the connection plug portion 400 such that an electric shock accident occurs due to the screw, the screw should not pass through the connection plug second body portion 420, and thus the second fastening groove 482 should be configured as a groove not a hole.

Subsequently, referring to FIGS. 14 to 19, the first fastening groove 481 includes a 1-1 fastening groove 481*a* located to be adjacent to the first pin portion 450 and a 1-2 fastening groove 481*b* disposed to be spaced at a certain interval from the 1-1 fastening groove 481*a* and located to be adjacent to the second pin portion 460.

Also, the second fastening groove 482 includes a 2-1 fastening groove 482*a* located to be adjacent to the first pin portion 450 and a 2-2 fastening groove 482*b* disposed to be spaced at a certain interval from the 2-1 fastening groove 482*a* and located to be adjacent to the second pin portion 460.

Here, although the number of grooves of each of the first fastening groove and the second fastening groove is two in the drawings, in the present invention, one or more grooves may be included and the number of such grooves is not limited.

However, in the present invention, when the connection plug is fastened to the one side of the body plug portion 200 and 300, the fastening hole 315 and the first fastening groove are located in corresponding areas and the fastening hole 315 and the second fastening groove are located in corresponding areas.

For example, as shown in the drawings, in a case that the number of grooves of each of the first fastening groove and the second fastening groove is two, when the first pin portion 450 of the connection plug portion 400 is inserted into the body plug portion 200 and 300, the fastening hole 315 and the 1-1 fastening groove 481*a* are located in corresponding areas or the fastening hole 315 and the 2-1 fastening groove 482*a* are located in corresponding areas.

Also, on the other hand, while the number of grooves of each of the first fastening groove and the second fastening groove is two, when the second pin portion 460 of the connection plug portion 400 is inserted into the body plug portion 200 and 300, the fastening hole 315 and the 1-2 fastening groove 481*b* are located in corresponding areas or the fastening hole 315 and the 2-2 fastening groove 482*b* are located in corresponding areas.

Figure 20:
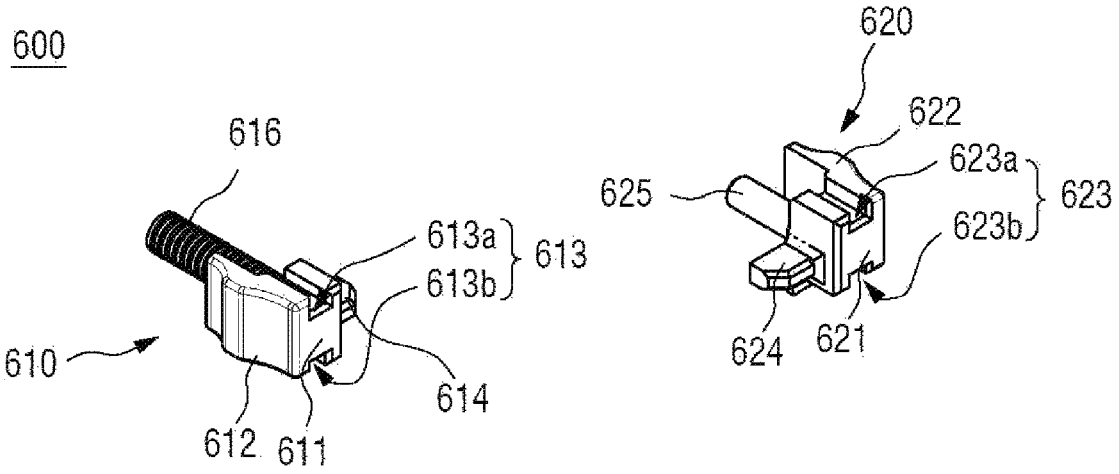
FIG. 20 is a perspective view illustrating a push portion according to the present invention.
Figure 21:
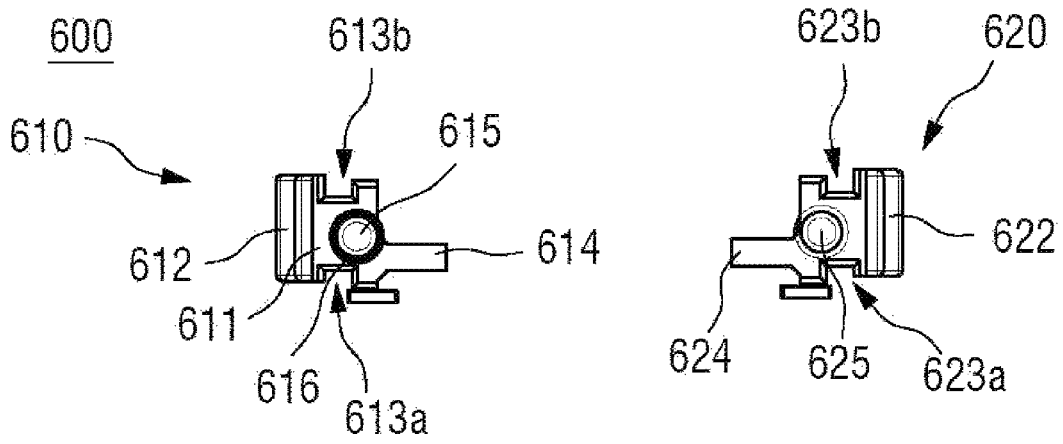
FIG. 21 is a bottom view illustrating the push portion according to the present invention.
Figure 22:
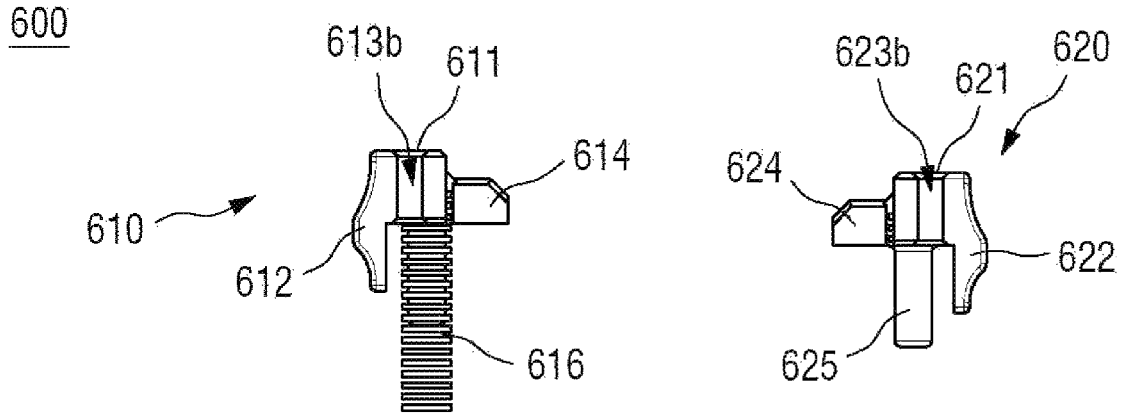
FIG. 22 is a front view illustrating the push portion according to the present invention.
Figure 23:
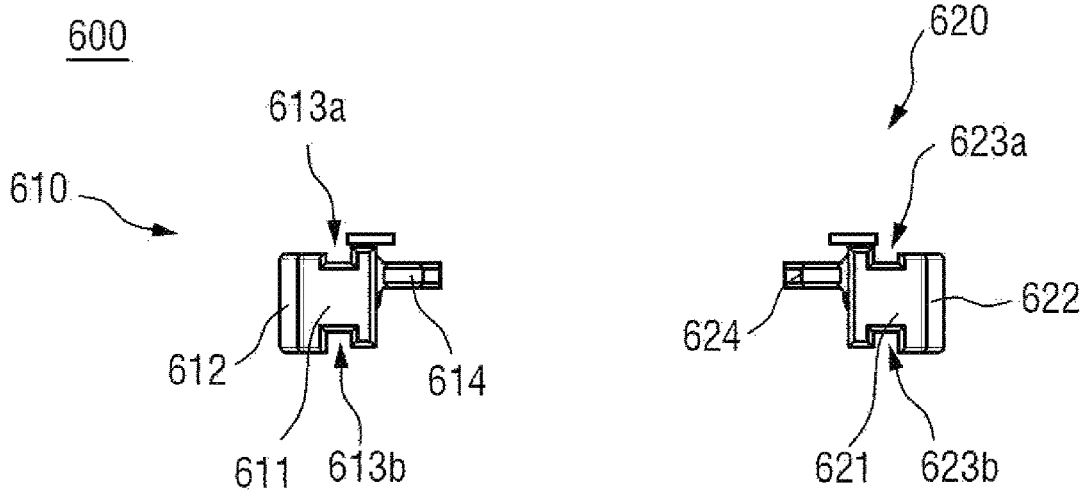
FIG. 23 is a plane view illustrating the push portion according to the present invention.

FIG. 20 is a perspective view illustrating the push portion according to the present invention, FIG. 21 is a bottom view illustrating the push portion according to the present invention, FIG. 22 is a front view illustrating the push portion according to the present invention, and FIG. 23 is a plane view illustrating the push portion according to the present invention.

Referring to FIGS. 20 to 23, the push portion 600 according to the present invention includes the first push portion 610 and the second push portion 620.

Meanwhile, as described above, the first push portion 610 is fastened to the first push portion first fastening portion 313 and the first push portion second fastening portion 213, and the second push portion 620 is fastened to the second push portion first fastening portion 314 and the second push portion second fastening portion 214.

In more detail, the first push portion 610 includes a first push portion body portion 611, a first push plate 612 located on an outer side surface of the first push portion body portion 611, a first concave portion 613 located on a rear surface and a front surface of the first push portion body portion 611, a first holding protruding portion 614 protruding from an inner side surface of the first push portion body portion 611, an elastic body first support portion 615 protruding from a bottom surface of the first push portion body portion 611, and a first elastic body 616 inserted into the elastic body first support portion 615.

Also, the second push portion 620 includes a second push portion body portion 621, a second push plate 622 located on an outer side surface of the second push portion body portion 621, a second concave portion 623 located on a rear surface and a front surface of the second push portion body portion 621, a second holding protruding portion 624 protruding from an inner side surface of the second push portion body portion 621, an elastic body second support portion 625 protruding from a bottom surface of the second push portion body portion 621, and a second elastic body (not shown) inserted into the elastic body second support portion 625.

Here, the first concave portion 613 includes a 1-1 concave portion 613*a* located on the rear surface of the first push portion body portion 611 and a 1-2 concave portion 613*b* located on the front surface of the first push portion body portion 611. The second concave portion 623 includes a 2-1 concave portion 623*a* located on the rear surface of the second push portion body portion 621 and a 2-2 concave portion 623*b* located on the front surface of the second push portion body portion 621.

As described above, the first push portion first fastening portion 313 includes the 1-1 protruding portion 313*a*, the 1-2 protruding portion 313*b* disposed to be spaced at a certain interval apart from the 1-1 protruding portion 313*a*, and the 1-1 gap 313*c* according to the interval between the 1-1 protruding portion 313*a* and the 1-2 protruding portion 313*b*. The second push portion first fastening portion 314 includes the 2-1 protruding portion 314*a*, the 2-2 protruding portion 314*b* disposed to be spaced at a certain interval from the 2-1 protruding portion 314*a*, and the 2-1 gap 314*c* according to the interval between the 2-1 protruding portion 314*a* and the 2-2 protruding portion 314*b*.

Also, as described above, the first push portion second fastening portion 213 includes the 1-3 protruding portion 213*a*, the 1-4 protruding portion 213*b* disposed to be spaced at a certain interval apart from the 1-3 protruding portion 213*a*, and the 1-2 gap 213*c* according to the interval between the 1-3 protruding portion 213*a* and the 1-4 protruding portion 213*b*. The second push portion second fastening portion 214 includes the 2-3 protruding portion 214*a*, the 2-4 protruding portion 214*b* disposed to be spaced at a certain interval from the 2-3 protruding portion 214*a*, and the 2-2 gap 214*c* according to the interval between the 2-3 protruding portion 214*a* and the 2-4 protruding portion 214*b*.

Here, the 1-1 protruding portion 313*a* of the first push portion first fastening portion 313 and the 1-3 protruding portion 213*a* of the first push portion second fastening portion 213 are inserted into the 1-1 concave portion 613*a*, and the 1-2 protruding portion 313*b* of the first push portion first fastening portion 313 and the 1-4 protruding portion 213*b* of the first push portion second fastening portion 213 are inserted into the 1-2 concave portion 613*b* such that the first push portion 610 may be fastened to the first push portion fastening portions 313 and 213.

Here, the 2-1 protruding portion 314*a* of the second push portion first fastening portion 314 and the 2-3 protruding portion 214*a* of the second push portion second fastening portion 214 are inserted into the 2-1 concave portion 623*a*, and the 2-2 protruding portion 314*b* of the second push portion first fastening portion 314 and the 2-4 protruding portion 214*b* of the second push portion second fastening portion 214 are inserted into the 2-2 concave portion 623*b* such that the second push portion 620 may be fastened to the second push portion fastening portions 314 and 214.

Meanwhile, as described above with reference to FIGS. 14 to 19, the connection plug 400 according to the present invention includes the first slit portion 471 located on the first side surface of the connection plug body portion 410 and 420 and the second slit portion 472 located on the second side surface of the connection plug body portion 410 and 420.

In more detail, the first slit portion 471 includes the 1-1 slit 471*a* located on the first side surface of the connection plug body portion 410 and 420 to be adjacent to the first pin portion 450 and the 1-2 slit 471*b* located on the first side surface of the connection plug body portion 410 and 420 to be adjacent to the second pin portion 460. Also, the second slit portion 472 includes the 2-1 slit 472*a* located on the second side surface of the connection plug body portion 410 and 420 to be adjacent to the first pin portion 450 and the 2-2 slit 472*b* located on the second side surface of the connection plug body portion 410 and 420 to be adjacent to the second pin portion 460.

Here, in the present invention, when the connection plug is fastened to the one side of the body plug portion 200 and 300, some components of the push portion have to be insertable into slits of the slit portion as described above.

In more detail, some component of the push portion, that is, the first holding protruding portion 614 of the first push portion 610 and the second holding protruding portion 624 of the second push portion 620, should be inserted into the slits of the slit portion.

For example, as shown in FIGS. 14 to 16, in a case in which the first slit portion 771 includes the 1-1 slit 471*a* and the 1-2 slit 471*b* and the second slit portion 772 includes the 2-1 slit 472*a* and the 2-2 slit 472*b*, when the first pin portion 450 of the connection plug portion 400 is inserted into the body plug portion 200 and 300, the first holding protruding portion 614 of the first push portion 610 should be inserted into the 1-1 slit 471*a* and the second holding protruding portion 624 of the second push portion 620 should be inserted into the 2-1 slit 472*a* or the first holding protruding portion 614 of the first push portion 610 should be inserted into the 2-1 slit 472*a* and the second holding protruding portion 624 of the second push portion 620 should be inserted into the 1-1 slit 471*a*.

Also, on the other hand, as shown in FIGS. 14 to 16, in a case in which the first slit portion 771 includes the 1-1 slit 471*a* and the 1-2 slit 471*b* and the second slit portion 772 includes the 2-1 slit 472*a* and the 2-2 slit 471*b*, when the second pin portion 460 of the connection plug portion 400 is inserted into the body plug portion 200 and 300, the first holding protruding portion 614 of the first push portion 610 should be inserted into the 1-2 slit 471*b* and the second holding protruding portion 624 of the second push portion 620 should be inserted into the 2-2 slit 472*b* or the first holding protruding portion 614 of the first push portion 610 should be inserted into the 2-2 slit 472*b* and the second holding protruding portion 624 of the second push portion 620 should be inserted into the 1-2 slit 471*b*.

Accordingly, when the first pin portion 450 of the connection plug portion 400 is inserted into the body plug portion 200 and 300 or the second pin portion 460 of the connection plug portion 400 is inserted into the body plug portion 200 and 300, it is possible to prevent the connection plug portion 400 from being separated from the body plug portion 200 and 300.

Meanwhile, in order to separate the connection plug portion 400 from the body plug portion 200 and 300, the above-described push plates, that is, the connection plug portion 400 may be separated from the body plug portion 200 and 300 by releasing a state in which the first holding protruding portion 614 of the first push portion 610 and the second holding protruding portion 624 of the second push portion 620 are inserted into the slits of the slit portion by pushing the first push plate 612 of the first push portion 610 and the second push plate 622 of the second push portion 620.

For example, on the basis of FIG. 22, the first holding protruding portion 614 of the first push portion 610 and the second holding protruding portion 624 of the second push portion 620 are moved downward by pushing the first push plate 612 of the first push portion 610 and the second push plate 622 of the second push portion 620 from an upward direction to a downward direction such that the state in which the first holding protruding portion 614 of the first push portion 610 and the second holding protruding portion 624 of the second push portion 620 are inserted into the slits of the slit portion may be released and then the connection plug portion 400 may be separated from the body plug portion 200 and 300.

Here, when the first push plate 612 of the first push portion 610 and the second push plate 622 of the second push portion 620 are pushed from the upward direction to the downward direction, the first elastic body 616 and the second elastic body are compressed. When a force of pushing the first push plate 612 of the first push portion 610 and the second push plate 622 of the second push portion 620 from the upward direction to the downward direction is eliminated, the compressed first elastic body 616 and the compressed second elastic body may return to original states and then the first push portion and the second push portion may return to initial positions.

Figure 24:
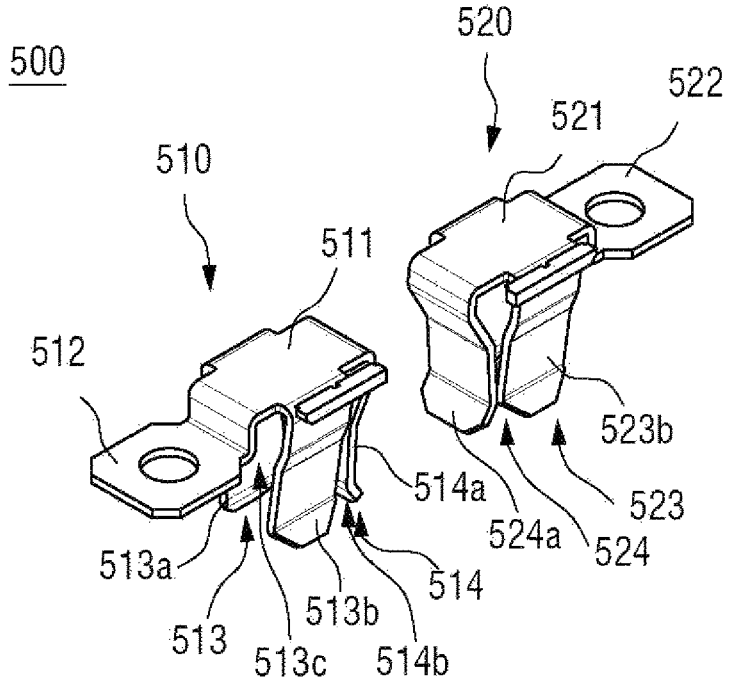
FIG. 24 is a perspective view illustrating a pin portion connection terminal according to the present invention.
Figure 25:
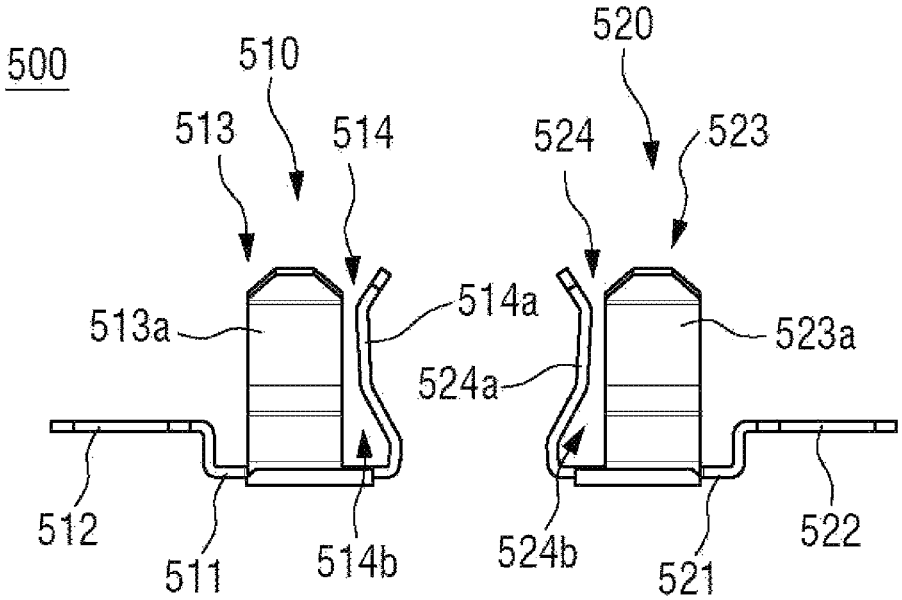
FIG. 25 is a plane view illustrating the pin portion connection terminal according to the present invention.

FIG. 24 is a perspective view illustrating the pin portion connection terminal according to the present invention, and FIG. 25 is a plane view illustrating the pin portion connection terminal according to the present invention.

Referring to FIGS. 24 and 25, as described above, the connection plug portion pin portion connection portion 320 (refer to FIG. 9) includes the pin portion connection terminal 500 and the pin portion connection terminal disposition portion 321 (refer to FIG. 9).

Here, the pin portion connection terminal 500 includes the pin portion first connection terminal 510 and the pin portion second connection terminal 520 disposed to be spaced at a certain interval apart from the pin portion first connection terminal 510. The pin portion connection terminal disposition portion 321 may include the pin portion first connection terminal disposition portion 321*a* on which the pin portion first connection terminal 510 is disposed and the pin portion second connection terminal disposition portion 321*b* on which the pin portion second connection terminal 520 is disposed.

In more detail with respect to the pin portion connection terminal 500, first, the pin portion first connection terminal 510 includes a first base terminal 511, a first fastening terminal 512 extending from a lateral surface of one side of the first base terminal 511 in a longitudinal direction, a first pin portion first insertion portion 514 located in a 1-1 area above the first base terminal 511, and a second pin portion first insertion portion 513 located in a 1-2 area above the first base terminal 511 to be adjacent to the first pin portion first insertion portion 514.

Here, the first fastening terminal 512 is connected to a wire or a circuit so that power may be finally applied to a product connected to the wire or the circuit.

Also, the first pin portion first insertion portion 514 includes a 1-1 plate 514*a* which extends from a lateral surface of the other side of the first base terminal 511 in the longitudinal direction and is located in a state of being bent from the first base terminal 511 at a certain angle.

Also, the second pin portion first insertion portion 513 includes a 1-2 plate 513*a*, which extends from a lateral surface of one side of the first base terminal 511 in a width direction and is located in a state of being bent from the first base terminal 511 at a certain angle and a 1-3 plate 513*b* which is disposed to face the 1-2 plate 513*a*, extends from a lateral surface of the other side of the first base terminal 511 in the width direction and is located in a state of being bent from the first base terminal 511 at a certain angle.

Here, the first pin portion first insertion portion 514 includes a first pin portion first insertion space 514*b* located between the 1-2 plate 513*a*, a side surface of the 1-3 plate 513*b*, and a plate surface of the 1-1 plate 514*a*. Also, the second pin portion first insertion portion 513 includes a second pin portion first insertion space 513*c* located between a plate surface of the 1-2 plate 513*a* and a plate surface of the 1-3 plate 513*b*.

Next, the pin portion second connection terminal 520 includes a second base terminal 521, a second fastening terminal 522 extending from a lateral surface of one side of the second base terminal 521 in a longitudinal direction, a first pin portion second insertion portion 524 located in a 2-1 area above the second base terminal 521, and a second pin portion second insertion portion 523 located in a 2-2 area above the second base terminal 521 to be adjacent to the first pin portion second insertion portion 524.

Here, the second fastening terminal 522 is connected to a wire or a circuit so that power may be eventually applied to a product connected to the wire or the circuit.

Also, the first pin portion second insertion portion 524 includes a 2-1 plate 524*a* which extends from a lateral surface of the other side of the second base terminal 521 in the longitudinal direction and is located in a state of being bent from the second base terminal 521 at a certain angle.

Also, the second pin portion second insertion portion 523 includes a 2-2 plate 523*a*, which extends from a lateral surface of one side of the second base terminal 521 in a width direction and is located in a state of being bent from the second base terminal 521 at a certain angle and a 2-3 plate 523*b* which is disposed to face the 2-2 plate 523*a*, extends from a lateral surface of the other side of the second base terminal 521 in the width direction and is located in a state of being bent from the second base terminal 521 at a certain angle.

Here, the first pin portion second insertion portion 524 includes a first pin portion second insertion space 524*b* located between the 2-2 plate 523*a*, a side surface of the 2-3 plate 523*b*, and a plate surface of the 2-1 plate 524*a*. Also, the second pin portion second insertion portion 523 includes a second pin portion second insertion space 523*c* located between a plate surface of the 2-2 plate 523*a* and a plate surface of the 2-3 plate 523*b*.

Meanwhile, the one side 1-1 pin 451*a* and the one side 1-2 pin 452*a* may protrude outward from the connection plug body portion 410 and 420 and be inserted into an electrical outlet. Also, the one side 2-1 pin 461*a* and the one side 2-2 pin 462*a* may protrude from the connection plug body portion 410 and 420 and be inserted into the electrical outlet.

Here, for example, when the one side 1-1 pin 451*a* and the one side 1-2 pin 452*a* are inserted into the electrical outlet, the one side 2-1 pin 461*a* and the one side 2-2 pin 462*a* are fastened to the pin portion connection terminal 500. In more detail, the one side 2-1 pin 461*a* is fastened to the second pin portion first insertion space 513*c* and the one side 2-2 pin 462*a* is fastened to the second pin portion second insertion space 523*c*.

Also, for example, when the one side 2-1 pin 461*a* and the one side 2-2 pin 462*a* are inserted into the electrical outlet, the one side 1-1 pin 451*a* and the one side 1-2 pin 452*a* are fastened to the pin portion connection terminal 500. In more detail, the one side 1-1 pin 451*a* is fastened to the first pin portion first insertion space 514*b* and the one side 1-2 pin 452*a* is fastened to the first pin portion second insertion space 524*b*.

Accordingly, when the one side 1-1 pin 451*a* and the one side 1-2 pin 452*a* are inserted into the electrical outlet, power transferred to the one side 2-1 pin 461*a* and the one side 2-2 pin 462*a* is transferred to the pin portion connection terminal 500. The pin portion connection terminal is connected to a wire or a circuit such that the power may be finally applied to a product connected to the wire or the circuit.

Also, on the other hand, when the one side 2-1 pin 461*a* and the one side 2-2 pin 462*a* are inserted into the electrical outlet, power transferred to the one side 1-1 pin 451*a* and the one side 1-2 pin 452*a* is transferred to the pin portion connection terminal 500. The pin portion connection terminal is connected to a wire or a circuit such that the power may be finally applied to a product connected to the wire or the circuit.

As described above, the one side 1-1 pin 451*a* and the one side 1-2 pin 452*a* may protrude outward from the connection plug body portion 410 and 420 and be inserted into the electrical outlet. Also, the one side 2-1 pin 461*a* and the one side 2-2 pin 462*a* may protrude from the connection plug body portion 410 and 420 and be inserted into the electrical outlet.

For example, when the one side 1-1 pin 451*a* and the one side 1-2 pin 452*a* are inserted into the electrical outlet, the one side 1-1 pin 451*a* and the one side 1-2 pin 452*a* receive power from the electrical outlet. The power applied to the one side 1-1 pin 451*a* and the one side 1-2 pin 452*a* may be transferred to the one side 2-1 pin 461*a* and the one side 2-2 pin 462*a*.

Also, the power transferred to the one side 2-1 pin 461*a* and the one side 2-2 pin 462*a* is transferred to the pin portion connection terminal and the pin portion connection terminal is connected to a wire or a circuit so that the power may be finally applied to a product connected to the wire or the circuit.

Also, on the other hand, for example, when the one side 2-1 pin 461*a* and the one side 2-2 pin 462*a* are inserted into the electrical outlet, the one side 2-1 pin 461*a* and the one side 2-2 pin 462*a* receive power from the electrical outlet. The power applied to the one side 2-1 pin 461*a* and the one side 2-2 pin 462*a* may be transferred to the one side 1-1 pin 451*a* and the one side 1-2 pin 452*a*.

Also, the power transferred to the one side 1-1 pin 451*a* and the one side 1-2 pin 452*a* is transferred to the pin portion connection terminal and the pin portion connection terminal is connected to a wire or a circuit so that the power may be finally applied to a product connected to the wire or the circuit.

Accordingly, in the present invention, since whether the second pin portion of the connection plug is inserted into an electrical outlet or the first pin portion of the connection plug is inserted into the electrical outlet varies depending on whether the first pin portion is inserted into the body plug portion or the second pin portion is inserted into the body plug portion, a plug for a combined use which is applicable to a variety of electrical outlets having different forms may be provided.

Although the embodiments of the present invention have been described above with reference to the attached drawings, it can be understood by one of ordinary skill in the art that the present invention may include other detailed forms without departing from the technical concept or essential features thereof. Therefore, it should be understood that the above-described embodiments are exemplary and not limitative in every aspect.

The invention claimed is:

1. A plug comprising:

a body plug portion;

a connection plug portion attached to or detached from one side of the body plug portion; and a push portion fastened to a lateral surface of the body plug portion, wherein the body plug portion comprises a body plug portion body portion and a body plug portion cover portion which covers the body plug portion body portion, wherein the body plug portion body portion comprises a connection plug portion body portion first mounting portion on which the connection plug portion body portion of the connection plug portion is mounted, and wherein the connection plug portion body portion first mounting portion comprises a first base plate, a first space portion formed above the first base plate, and a fastening hole which is located in an area of the first space portion and passes through the first base plate, wherein the connection plug portion comprises a connection plug body portion, a first pin portion located on one side of the connection plug body portion, a second pin portion located on the other side of the connection plug body portion, a first slit portion located on a first side surface of the connection plug body portion, and a second slit portion located on a second side surface of the connection plug body portion, wherein the connection plug body portion comprises a connection plug first body portion and a connection plug second body portion fastened to the connection plug first body portion and comprises a first fastening groove located in a certain area of the connection plug first body portion and a second fastening groove located in a certain area of the connection plug second body portion, wherein the first fastening groove comprises a 1-1 fastening groove located to be adjacent to the first pin portion and a 1-2 fastening groove disposed to be spaced at a certain interval apart from the 1-1 fastening groove and located to be adjacent to the second pin portion, the second fastening groove comprises a 2-1 fastening groove located to be adjacent to the first pin portion and a 2-2 fastening groove disposed to be spaced at a certain interval apart from the 2-1 fastening groove and located to be adjacent to the second pin portion, the first slit portion comprises a 1-1 slit located to be adjacent to the first pin portion and a 1-2 slit located to be adjacent to the second pin portion, and the second slit portion comprises a 2-1 slit located to be adjacent to the first pin portion and a 2-2 slit located to be adjacent to the second pin portion, wherein the push portion comprises a first push portion fastened to a first side of the body plug portion body portion and a second push portion fastened to a second side of the body plug portion body portion, wherein the connection plug portion body portion first mounting portion comprises a first push portion first fastening portion located on a first side of the first base plate and a second push portion first fastening portion located on a second side of the first base plate, wherein the first push portion comprises a first push portion body portion, a first push plate located on an outer side surface of the first push portion body portion, a first concave portion located on a rear surface and a front surface of the first push portion body portion, a first holding protruding portion protruding from an inner side surface of the first push portion body portion, an elastic body first support portion protruding from a bottom surface of the first push portion body portion, and a first elastic body inserted into the elastic body first support portion, wherein the second push portion comprises a second push portion body portion, a second push plate located on an outer side surface of the second push portion body portion, a second concave portion located on a rear surface and a front surface of the second push portion body portion, a second holding protruding portion protruding from an inner side surface of the second push portion body portion, an elastic body second support portion protruding from a bottom surface of the second push portion body portion, and a second elastic body inserted into the elastic body second support portion, and wherein the first concave portion comprises a 1-1 concave portion located on the rear surface of the first push portion body portion and a 1-2 concave portion located on the front surface of the first push portion body portion, and the second concave portion comprises a 2-1 concave portion located on the rear surface of the second push portion body portion and a 2-2 concave portion located on the front surface of the second push portion body portion.

2. The plug of claim 1, wherein while the connection plug portion is fastened to one side of the body plug portion, the fastening hole and the first fastening groove are fastened using fixing means, or while the connection plug portion is fastened to the one side of the body plug portion, the fastening hole and the second fastening groove are fastened using the fixing means.

3. The plug of claim 1, wherein when the first pin portion is inserted into the body plug portion, the fastening hole and the 1-1 fastening groove are located in corresponding areas or the fastening hole and the 2-1 fastening groove are located in corresponding areas, and wherein when the second pin portion is inserted into the body plug portion, the fastening hole and the 1-2 fastening groove are located in corresponding areas or the fastening hole and the 2-2 fastening groove are located in corresponding areas.

4. The plug of claim 1, wherein when the first pin portion is inserted into the body plug portion, the first holding protruding portion is inserted into the 1-1 slit and the second holding protruding portion is inserted into the 2-1 slit or the first holding protruding portion is inserted into the 2-1 slit and the second holding protruding portion is inserted into the 1-1 slit, and wherein when the second pin portion is inserted into the body plug portion, the first holding protruding portion is inserted into the 1-2 slit and the second holding protruding portion is inserted into the 2-2 slit or the first holding protruding portion is inserted into the 2-2 slit and the second holding protruding portion is inserted into the 1-2 slit.

5. A plug comprising:

a body plug portion;

a connection plug portion attached to or detached from one side of the body plug portion; and a push portion fastened to a lateral surface of the body plug portion, wherein the body plug portion comprises a body plug portion body portion and a body plug portion cover portion which covers the body plug portion body portion, wherein the body plug portion body portion comprises a connection plug portion body portion first mounting portion on which the connection plug portion body portion of the connection plug portion is mounted, and wherein the connection plug portion body portion first mounting portion comprises a first base plate, a first space portion formed above the first base plate, and a fastening hole which is located in an area of the first space portion and passes through the first base plate, wherein the connection plug portion comprises a connection plug body portion, a first pin portion located on one side of the connection plug body portion, a second pin portion located on the other side of the connection plug body portion, a first slit portion located on a first side surface of the connection plug body portion, and a second slit portion located on a second side surface of the connection plug body portion, wherein the connection plug body portion comprises a connection plug first body portion and a connection plug second body portion fastened to the connection plug first body portion and comprises a first fastening groove located in a certain area of the connection plug first body portion and a second fastening groove located in a certain area of the connection plug second body portion, wherein the body plug portion body portion comprises a connection plug portion pin portion first connection portion located consecutively with the connection plug portion body portion first mounting portion, wherein the connection plug portion pin portion first connection portion comprises a pin portion connection terminal, wherein the pin portion connection terminal comprises a pin portion first connection terminal and a pin portion second connection terminal disposed to be spaced at a certain interval apart from the pin portion first connection terminal, wherein the pin portion first connection terminal comprises a first base terminal, a first fastening terminal extending from a side surface of one side of the first base terminal in a longitudinal direction, a first pin portion first insertion portion located in a 1-1 area above the first base terminal, and a second pin portion first insertion portion located in a 1-2 area above the first base terminal to be adjacent to the first pin portion first insertion portion, wherein the first pin portion first insertion portion comprises a 1-1 plate extending from a side surface of the other side of the first base terminal in the longitudinal direction and located in a state of being bent from the first base terminal at a certain angle, and the second pin portion first insertion portion comprises a 1-2 plate extending from a side surface of one side of the first base terminal in a width direction and located in a state of being bent from the first base terminal at a certain angle and a 1-3 plate which is disposed to face the 1-2 plate, extends from a side surface of the other side of the first base terminal in the width direction, and is located in a state of being bent from the first base terminal at a certain angle, wherein the first pin portion first insertion portion comprises a first pin portion first insertion space located between the 1-2 plate, a side surface of the 1-3 plate, and a plate surface of the 1-1 plate, and the second pin portion first insertion portion comprises a second pin portion first insertion space located between a plate surface of the 1-2 plate and a plate surface of the 1-3 plate, wherein the pin portion second connection terminal comprises a second base terminal, a second fastening terminal extending from a side surface of one side of the second base terminal in a longitudinal direction, a first pin portion second insertion portion located in a 2-1 area above the second base terminal, and a second pin portion second insertion portion located in a 2-2 area above the second base terminal to be adjacent to the first pin portion second insertion portion, wherein the first pin portion second insertion portion comprises a 2-1 plate extending from a side surface of the other side of the second base terminal in the longitudinal direction and located in a state of being bent from the second base terminal at a certain angle, and the second pin portion second insertion portion comprises a 2-2 plate extending from a side surface of one side of the second base terminal in a width direction and located in a state of being bent from the second base terminal at a certain angle and a 2-3 plate which is disposed to face the 2-2 plate, extends from a side surface of the other side of the second base terminal in the width direction, and is located in a state of being bent from the second base terminal at a certain angle, and wherein the first pin portion second insertion portion comprises a first pin portion second insertion space located between the 2-2 plate, a side surface of the 2-3 plate, and a plate surface of the 2-1 plate, and the second pin portion second insertion portion comprises a second pin portion second insertion space located between a plate surface of the 2-2 plate and a plate surface of the 2-3 plate.

* * * * *